US012774544B2

(12) United States Patent
Vater et al.

(10) Patent No.: US 12,774,544 B2
(45) Date of Patent: Oct. 27, 2026

(54) COFORM MATERIAL WITH STAPLE FIBERS AND PROCESS FOR FORMING COFORM MATERIALS

(71) Applicant: Kimberly-Clark Worldwide, Inc., Neenah, WI (US)

(72) Inventors: Allen Vater, Alpharetta, GA (US); Juha Kemppinen, Cumming, GA (US); Doug Gorman, Cumming, GA (US); Bryan D. Haynes, Jasper, GA (US); Simon Poruthoor, Alpharetta, GA (US); Karen Goeders, Atlanta, GA (US); Jeffrey Krueger, Roswell, GA (US); Scott Snowden, Canton, GA (US); Rebecca Griffin, Woodstock, GA (US); David J. Trebatoski, Atlanta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 18/293,479

(22) PCT Filed: Aug. 15, 2022

(86) PCT No.: PCT/US2022/040329
§ 371 (c)(1),
(2) Date: Jan. 30, 2024

(87) PCT Pub. No.: WO2023/022979
PCT Pub. Date: Feb. 23, 2023

(65) Prior Publication Data

US 2024/0344253 A1 Oct. 17, 2024

Related U.S. Application Data

(60) Provisional application No. 63/233,449, filed on Aug. 16, 2021.

(51) Int. Cl.
*D04H 1/407* (2012.01)
*A47L 13/17* (2006.01)
(Continued)

(52) U.S. Cl.
CPC ..... *D04H 1/407* (2013.01); *A47L 13/17* (2013.01); *D04H 1/425* (2013.01);
(Continued)

(58) Field of Classification Search
CPC ..... D04H 1/407; D04H 1/425; D04H 1/4258; D04H 1/435; D04H 1/43835;
(Continued)

(56) References Cited

U.S. PATENT DOCUMENTS 3,485,706 A 12/1969 Evans
3,849,241 A 11/1974 Butin et al.
(Continued)

FOREIGN PATENT DOCUMENTS

CA 1311351 C 12/1992
CN 1296094 A 5/2001
(Continued)

OTHER PUBLICATIONS

PCT Search Report Corresponding to Application No. PCT/US2022/040329 on Nov. 23, 2022.
(Continued)

*Primary Examiner* — Larissa Rowe Emrich
(74) *Attorney, Agent, or Firm* — Dority & Manning, P.A.

(57) ABSTRACT

A coform material is provided including a nonwoven web containing a mixture of staple fibers and an absorbent material including pulp fibers. The staple fibers are present in an amount of from about 5 wt. % to about 50 wt. % and the pulp fibers are present in an amount of from about 50 wt. % to about 95 wt. %. The staple fibers have an average length of from about 5 mm to about 50 mm. The staple fibers
(Continued)

and pulp fibers are thermally bonded or hydraulically entangled to form the nonwoven web. Methods and systems for producing coform materials are also provided.

17 Claims, 5 Drawing Sheets

(51) Int. Cl.

| | |
|---|---|
| ***D04H 1/425*** | (2012.01) |
| ***D04H 1/4258*** | (2012.01) |
| ***D04H 1/435*** | (2012.01) |
| ***D04H 1/4382*** | (2012.01) |
| ***D04H 1/4391*** | (2012.01) |
| ***D04H 1/492*** | (2012.01) |
| ***D04H 1/54*** | (2012.01) |
| ***D04H 1/732*** | (2012.01) |

(52) U.S. Cl.
CPC ..... *D04H 1/4258* (2013.01); *D04H 1/435* (2013.01); *D04H 1/43835* (2020.05); *D04H 1/43918* (2020.05); *D04H 1/492* (2013.01); *D04H 1/54* (2013.01); *D04H 1/732* (2013.01); *D10B 2331/04* (2013.01); *D10B 2401/063* (2013.01)

(58) Field of Classification Search
CPC ..... D04H 1/43918; D04H 1/492; D04H 1/54; D04H 1/732; D04H 1/4266
See application file for complete search history.

(56) References Cited

U.S. PATENT DOCUMENTS

| | | | | |
|---|---|---|---|---|
| 3,855,046 | A | 12/1974 | Hansen et al. | |
| 4,100,324 | A | 7/1978 | Anderson et al. | |
| 4,393,167 | A | 7/1983 | Holmes et al. | |
| 4,477,654 | A | 10/1984 | Holmes et al. | |
| 4,797,468 | A | 1/1989 | De Vries | |
| 4,879,170 | A * | 11/1989 | Radwanski | D04H 1/492 442/329 |
| 5,470,944 | A | 11/1995 | Bonsignore | |
| 5,770,682 | A | 6/1998 | Ohara et al. | |
| 5,821,237 | A | 10/1998 | Bissett et al. | |
| 5,880,254 | A | 3/1999 | Ohara et al. | |
| 6,326,458 | B1 | 12/2001 | Gruber et al. | |
| 6,932,929 | B2 | 8/2005 | Krautkramer et al. | |
| 7,258,758 | B2 | 8/2007 | Collier et al. | |
| 7,662,745 | B2 | 2/2010 | Zhang et al. | |
| 2002/0068081 | A1 | 6/2002 | Fontenot et al. | |
| 2003/0213109 | A1 | 11/2003 | Neely et al. | |
| 2004/0265577 | A1 * | 12/2004 | Goda | D04H 1/435 428/364 |
| 2007/0077834 | A1 * | 4/2007 | Hanson | A47L 13/20 156/60 |
| 2007/0197117 | A1 | 8/2007 | Austin et al. | |
| 2014/0170402 | A1 * | 6/2014 | Knowlson | D04H 1/492 264/103 |
| 2018/0326699 | A1 * | 11/2018 | Knowlson | D04H 1/43835 |
| 2019/0099301 | A1 | 4/2019 | Viens et al. | |
| 2019/0133841 | A1 | 5/2019 | Bewick-Sonntag et al. | |

FOREIGN PATENT DOCUMENTS

| | | | | |
|---|---|---|---|---|
| EP | 1689923 | B1 | 2/2015 | |
| WO | WO2018141677 | A1 | 8/2018 | |
| WO | WO2018149783 | A1 | 8/2018 | |
| WO | WO-2021126042 | A1 * | 6/2021 | A61F 13/53 |

OTHER PUBLICATIONS

Rebenfeld, Chapter VI—Fibers and Fibrous Materials, Textile Science and Technology, vol. 13, 2002, pp. 199-232.
Chinese Search Report Corresponding to Application No. 202280061318.3 on Dec. 26, 2025.

* cited by examiner

COFORM MATERIAL WITH STAPLE FIBERS AND PROCESS FOR FORMING COFORM MATERIALS

RELATED APPLICATIONS

The present application is the national stage entry of International Patent Application No. PCT/US2022/040329 having a filing date of Aug. 15, 2022, and Provisional Patent Application No. 63/233,449 having a filing date of Aug. 16, 2021, which are incorporated herein in their entirety by reference thereto.

BACKGROUND

Coform nonwoven webs, which typically include a matrix of meltblown fibers and an absorbent material (e.g., pulp fibers), have been used as an absorbent layer in a wide variety of applications, including absorbent articles, absorbent dry wipes, wet wipes, and mops. Coform nonwoven webs typically provide excellent cleaning due to their relatively high level of absorbency in comparison to other spunlace products. However, coform has been deficient in the areas of strength, specifically cross-direction (CD) tensile strength, and softness when compared to spunlace.

Most conventional coform webs employ meltblown fibers formed from thermoplastic materials, such as polyethylene or polypropylene. The inclusion of such thermoplastic materials facilitates bonding of the coform materials and provides strength to the resulting web. However, many new regulations put limits on the amount of plastic materials that can be used in certain products, including diapers, absorbent articles, feminine products, cleansing products, and wipes, including baby wipes and personal hygiene wipes. Certain regulations may even forbid the use of thermoplastic materials in certain consumer products. Accordingly, while polypropylene has long been utilized as the glue to hold pulp fibers in the coform matrix and provide strength to the base sheet, improved coform materials are now needed. Indeed, improved plastic-free coform products are needed that still have the strength and characteristics of coform materials that include polypropylene homopolymers.

In view of the above, a need exists for a nonwoven material suitable for use as a wiping product that not only has good strength, hand feel, wiping ability and absorbency, but is also free from plastic materials, such as polypropylene polymers.

SUMMARY

In general, the present disclosure is directed to a coform material including a nonwoven web containing a mixture of staple fibers and an absorbent material including pulp fibers. The staple fibers are present in the nonwoven web in an amount of from about 5 wt. % to about 50 wt. % and the pulp fibers are present in the nonwoven web in an amount of from about 50 wt. % to about 95 wt. %. The staple fibers have an average length of from about 5 mm to about 50 mm. The staple fibers and pulp fibers are thermally bonded or hydraulically entangled. A wiper product including the coform material as disclosed is also provided. The wiper product can be pre-saturated with a solvent, such as a cleaning solution.

The present disclosure is also directed to a method of producing a coform nonwoven web. The method includes merging together a stream of an absorbent material including pulp fibers with a stream of staple fibers to form a composite stream. The staple fibers are present in an amount of from about 5 wt. % to about 50 wt. % and the pulp fibers are present in an amount of from about 50 wt. % to about 95 wt. %. The staple fibers have an average length of from about 5 mm to about 50 mm. The method includes collecting the composite stream on a forming surface to form a coform nonwoven web; and bonding the coform nonwoven web. Bonding the coform nonwoven web can include (i) hydraulically entangling the coform nonwoven web or (ii) thermally bonding the coform nonwoven web.

The present disclosure also provides a system for forming a coform material. The system includes a first system configured to provide staple fibers and a second system configured to provide absorbent fibers. The system also includes a first air stream disposed in a first duct, the first duct configured with one or more openings to receive staple fibers from the first system and absorbent fibers from the second system. A second air stream configured to disperse the staple fibers from the first system in the first air stream via a second duct is also provided. Also included is a third air stream configured to disperse the absorbent fibers with the first air stream containing the staple fibers in the first duct forming a composite stream. The third airstream is disposed downstream from the second air stream. Also included is a nozzle disposed on an end of the first duct for depositing the composite stream on a forming surface.

Other features and aspects of the present disclosure are discussed in greater detail below.

BRIEF DESCRIPTION OF DRAWINGS

A full and enabling disclosure of the present disclosure is set forth more particularly in the remainder of the specification, including reference to the accompanying figures, in which.

Figure 1:
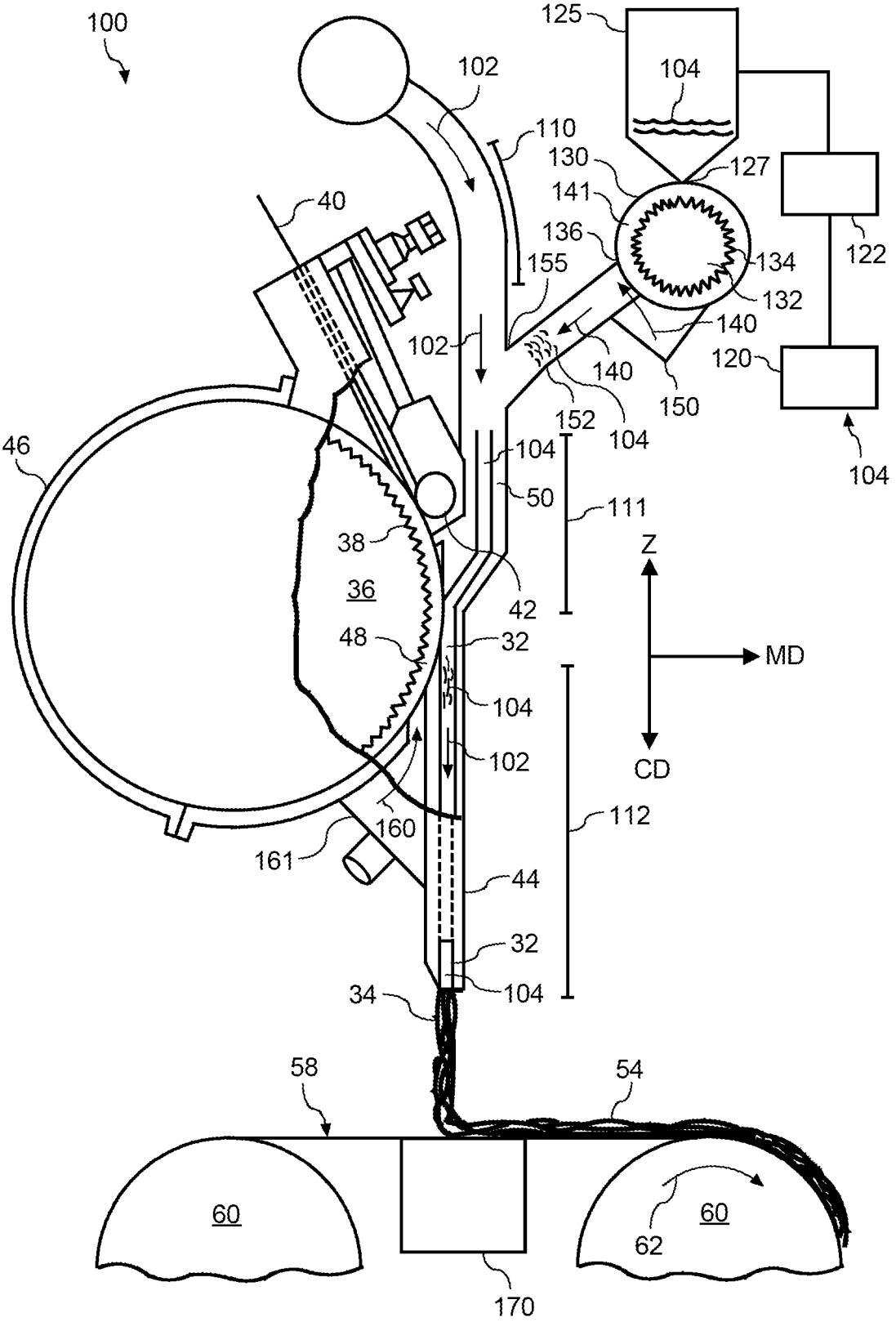
FIG. 1 is a schematic illustrating a system for forming a coform according to example embodiments of the present disclosure.

Repeat use of reference characters in the present specification and drawings is intended to represent the same or analogous features or elements of the present disclosure.

Definitions

As used herein the term "nonwoven fabric or web" or "nonwoven" means a web having a structure of individual fibers or threads which are interlaid, but not in an identifiable manner as in a knitted fabric. Nonwoven fabrics or webs have been formed from many processes such as for example, dry-laid processes, wet-laid processes, and melt-spun processes. The basis weight of nonwoven fabrics is usually expressed in ounces of material per square yard (osy) or grams per square meter ($g/m^2$ or gsm) and the fiber diameters useful are usually expressed in microns. (Note that to convert from osy to gsm, multiply osy by 33.91).

As used herein, the term "coform nonwoven web" or "coform material" refers to composite materials containing a mixture or stabilized matrix of two materials. For example, the coform materials provided herein can include nonwoven webs including staple fibers in combination with absorbent materials. Such embodiments do not include thermoplastic fibers (e.g., meltblown fibers) and can be considered "plastic free". However, in other embodiments, the coform material can include staple fibers, absorbent materials, and thermoplastic fibers.

As used herein, the term "comprising" is inclusive or open-ended and does not exclude additional unrecited elements, compositional components, or method steps.

As used herein, the term "substantially free" and "free from" are understood to mean completely free of said constituent, or inclusive of trace amounts of the same. "Trace amounts" are those quantity levels of constituent that are barely detectable and provide no benefit to the functional or aesthetic properties of the subject composition.

The term "fiber" when used herein means an elongate particulate having a length exceeding its width or diameter, e.g., a length to width ratio of greater than 10. A "fiber" can be continuous, such as a continuous filament, or discontinuous. One example of a discontinuous fiber is an elongate particulate that has a length of less than 3 cm. Non-limiting examples of discontinuous fibers include hardwood and softwood pulp fibers; hemp bast; bagasse; bamboo; corn stalk; cotton; cotton stalk; cotton linters; esparto grass; flax tow; jute bast; kenaf bast; reed; rice straw, sisal; switch grass; wheat straw; and synthetic staple (i.e., cut or chopped) fibers made from polyester, nylons, rayon (including viscose and lyocell), polyolefins such as polypropylene and polyethylene, natural polymers, such as starch, starch derivatives, cellulose and cellulose derivatives, hemicelulose, hemicellulose derivatives, chitin, chitosan, polyisoprene (cis and trans), peptides, polyhydroxyalkanoates, copolymers of polyolefins such as polyethylene-octene, and biodegradable or compostable thermoplastics such as polylactic acid, polyvinyl alcohol, and polycaprolactone. In addition to staple fibers, synthetic fibers can also be continuous. Synthetic fibers may be monocomponent or multicomponent, e.g., bicomponent. As used herein, the term "fiber" includes both staple fibers, i.e., fibers which have a defined length between about 5 mm and about 50 mm, fibers longer than staple fiber but are not continuous, and continuous fibers, which are sometimes called "substantially continuous filaments" or simply "filaments". The method in which the fiber is prepared will determine if the fiber is a staple fiber or a continuous filament.

As used herein, the term "meltblown fibers" generally refers to melt-spun fibers that are formed by a process in which a molten thermoplastic material is extruded through a plurality of fine, usually circular, die capillaries as molten fibers into converging high velocity gas (e.g., air) streams that attenuate the fibers of molten thermoplastic material to reduce their diameter, which may be to microfiber diameter. Thereafter, the meltblown fibers are carried by the high velocity gas stream and are deposited on a collecting surface to form a web of randomly dispersed meltblown fibers. Such a process is disclosed, for example, in U.S. Pat. No. 3,849,241 to Butin, et al., which is incorporated herein in its entirety by reference thereto for all purposes. Generally speaking, meltblown fibers may be microfibers that are substantially continuous or discontinuous and are generally tacky when deposited onto a collecting surface. The meltblown fibers can include microfibers generally having an average fiber diameter of between 1 micron to about 50 microns.

The term "machine direction" or "MD" as used herein with respect to a nonwoven web means the direction parallel to the predominant direction of movement of the nonwoven web through its manufacturing line and can also refer to the length direction.

The term "cross-machine direction" or "CD" when used herein with respect to a nonwoven web means the direction perpendicular to the predominant direction of movement of the nonwoven web structure through its manufacturing line (referred to as the "machine direction") and can also be referred to as the width direction.

As used herein, the term "polymer" generally includes, but is not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configurations of the molecule. These configurations include, but are not limited to isotactic, syndiotactic and random symmetries.

The term "melt flow rate" (MFR) when used herein is a measure of the ease of flow of the melt of a polymer composition. MFR is measured according to ISO 1133-1 and is described in the test method section below. MFR has units of g/10 minutes and is the measurement of the mass of a polymer, in grams, flowing in ten minutes through a capillary of a specific diameter and length by a pressure applied via prescribed alternative gravimetric weights for alternative prescribed temperatures.

As used herein, "absorbent article" refers to an article that is capable of absorbing water or other fluids. Examples of some absorbent articles include, but are not limited to, personal care absorbent articles, such as diapers, training pants, absorbent underpants, incontinence articles, feminine hygiene products (e.g., sanitary napkins), swim wear, baby wipes, mitt wipe, and so forth; medical absorbent articles, such as garments, fenestration materials, underpads, bedpads, bandages, absorbent drapes, and medical wipes; food service wipers; clothing articles; pouches, and so forth. Materials and processes suitable for forming such articles are well known to those skilled in the art. In one particular embodiment of the present disclosure, the coform web is used to form a wipe or wiper product.

The term "biodegradable," as used herein, refers generally to a material that can degrade from the action of naturally occurring microorganisms, such as bacteria, fungi, yeasts, and algae; environmental heat, moisture, or other environmental factors. If desired, the extent of biodegradability may be determined according to ASTM Test Method 5338.92.

The term "renewable" as used herein refers to a material that can be produced or is derivable from a natural source which is periodically (e.g., annually or perennially) replenished through the actions of plants of terrestrial, aquatic or oceanic ecosystems (e.g., agricultural crops, edible and non-edible grasses, forest products, seaweed, or algae), or microorganisms (e.g., bacteria, fungi, or yeast).

As used herein, the term "carded web" refers to a web made from staple fibers that are sent through a combing or carding unit, which separates or breaks apart and aligns the staple fibers in the machine direction to form a generally machine direction-oriented fibrous nonwoven web. Such fibers are usually obtained in bales and placed in an opener/blender or picker, which separates the fibers prior to the carding unit. Once formed, the web may then be bonded by one or more known methods.

As used herein, the term "airlaid web" refers to a web made from bundles of fibers having typical lengths ranging from about 3 to about 50 millimeters (mm). The fibers are separated, entrained in an air supply, and distributed through a rotating cylinder or rotating drum that is perforated with holes to allow for the fibers to pass through and be deposited onto a forming surface, usually with the assistance of a vacuum supply. Thus, airlaid webs refer to webs that are disposed on the forming surface via a rotating perforated drum. Once formed, the web is then bonded by one or more known methods.

As used herein, the term "air-formed process" refers to a process that is not a wet-laid process nor an air-laid process. Specifically, the air-formed process of the present disclosure does not utilize a perforated air cylinder to facilitate formation of the nonwoven material. The air-formed process of the present disclosure differs from the process utilized to form carded webs, in that no combing or carding unit is utilized. The air-formed process is configured to distributed airstreams containing different materials to form a composite stream that is then deposited on a forming surface. The air-formed process as disclosed herein can be utilized to form nonwoven materials, such as, for example, coform materials.

The term "tensile strength" when used herein refers to a measure of the ability of a material to withstand a longitudinal stress, expressed as the greatest stress that the material can stand without breaking. Tensile strength is expressed in grams per unit of force (gf).

The term "Z-direction" wherein used herein means the direction orthogonal to the plane defined by the machine direction and cross-machine direction of the nonwoven web or fibrous web structure.

As used herein, use of the term "about" in conjunction with a stated numerical value can include a range of values within 10% of the stated numerical value.

DETAILED DESCRIPTION

It is to be understood by one of ordinary skill in the art that the present discussion is a description of exemplary embodiments only, and is not intended as limiting the broader aspects of the present disclosure.

Generally, conventional coform materials include require merging an air stream of absorbent material (e.g., pulp material) with thermoplastic polymer fibers (e.g., meltblown fibers). The pulp material is interconnected within the thermoplastic fiber matrix and held captive by the matrix in order to facilitate mechanical entanglement of the thermoplastic fibers with the pulp material. This mechanical entanglement and interconnection of the thermoplastic fibers with the pulp material forms an integrated fiber structure that provides a homogenous material having certain strength and durability. Accordingly, removal of the thermoplastic component from the coform material can significantly undermine the strength and bonding of the coform materials and can further present unique manufacturing challenges. However, the present inventors have discovered that specific staple fibers can be introduced to an absorbent material stream to create a coform material that is substantially free from thermoplastic materials and yet still is able to meet certain strength and absorbency characteristics desired for coform materials.

Advantageously the coform material disclosed herein and products made from the coform material can be substantially free from thermoplastic polymers. For example, the coform material can be substantially free from certain thermoplastic polymers used to form coform materials, such as polyolefins, for example, polyethylene, polypropylene, polybutylene and the like, polyamides, and polyesters. Accordingly, the coform materials provide "plastic-free" variants.

In general, the present disclosure is directed to a coform material having a synergistic blend of properties and to wiping products, methods, devices, and systems for forming the coform material disclosed herein. For example, the coform material disclosed provides a nonwoven web containing a mixture of staple fibers and absorbent material (e.g., pulp fibers). The staple fibers are present in an amount of from about 5 wt. % to about 25 wt. % and the pulp fibers are present in an amount of from about 80 wt. % to about 95 wt. %. The staples fibers have an average length of from about 5 mm to about 50 mm, such as from about 10 mm to about 20 mm, such as about 18 mm. Use of the staple fibers as disclosed can impart strength to the web while being present in a lower weight percentage as compared to other meltblown, spunbond, or coform materials. Accordingly, use of the staple fibers as disclosed, can reduced manufacturing costs and can further facilitate methods utilized to form the coform material disclosed herein.

I. Staple Fibers

The staple fibers can include renewable, biodegradable, and/or natural polymers. For example, in certain embodiments, the staple fibers comprise one or more biopolymer materials. The biopolymer material employed in the present disclosure may include, for instance, starches (e.g., thermoplastic starch (TPS)), as well as other carbohydrate polymers, such as cellulose or cellulose derivatives (e.g., cellulose ethers and esters), hemicelulose, etc.; lignin derivatives; protein materials (e.g., gluten, soy protein, zein, etc.); algae materials; alginate; etc., as well as combinations thereof.

For example, starch is a biopolymer composed of amylose and amylopectin. Amylose is essentially a linear polymer having a molecular weight in the range of 100,000-500,000, whereas amylopectin is a highly branched polymer having a molecular weight of up to several million. Although starch is produced in many plants, typical sources includes seeds of cereal grains, such as corn, waxy corn, wheat, sorghum, rice, and waxy rice; tubers, such as potatoes; roots, such as tapioca (i.e., cassava and manioc), sweet potato, and arrowroot; and the pith of the sago palm.

In certain embodiments, the biopolymer material comprises polyhydroxyalkanoates (PHAs). Polyhydroxyalkanoates (PHAs) are generally semicrystalline, thermoplastic polyester compounds that can either be produced by synthetic methods or by a variety of microorganisms, such as bacteria or algae. The latter typically produce optically pure materials. Traditionally known bacterial PHAs include isotactic poly(3-hydroxybutyrate), or PHB, the high-melting, highly crystalline, very fragile/brittle, homopolymer of hydroxybutyric acid, and isotactic poly(3-hydroxybutyrate-co-valerate), or PHBV, the somewhat lower crystallinity and lower melting copolymer that nonetheless suffers the same drawbacks of high crystallinity and fragility/brittleness. PHBV copolymers are described in Holmes, et al. U.S. Pat. Nos. 4,393,167 and 4,477,654; and until recently were commercially available from Monsanto under the trade name BIOPOL. Their ability to biodegrade readily in the presence of microorganisms has been demonstrated in numerous instances.

Other known PHAs are the so-called medium to long side-chain PHAs, such as isotactic polyhydroxyoctanoates (PHOs). These, unlike PHB or PHBV, are virtually amorphous owing to the recurring pentyl and higher alkyl side-chains that are regularly spaced along the backbone.

In certain embodiments, the staple fibers comprise polylactic acid (PLA). Polylactic acid may generally be derived from monomer units of any isomer of lactic acid, such as levorotory-lactic acid ("L-lactic acid"), dextrorotatory-lactic acid ("D-lactic acid"), meso-lactic acid, or mixtures thereof. Monomer units may also formed from anhydrides of any isomer of lactic acid, including L-lactide, D-lactide, meso-lactide, or mixtures thereof. Cyclic dimers of such lactic acids and/or lactides may also be employed. Any known polymerization method, such as polycondensation or ring-opening polymerization, may be used to polymerize lactic acid. A small amount of a chain-extending agent (e.g., a diisocyanate compound, an epoxy compound or an acid anhydride) may also be employed. The polylactic acid may be a homopolymer or a copolymer, such as one that contains monomer units derived from L-lactic acid and monomer units derived from D-lactic acid. Although not required, the rate of content of one of the monomer unit derived from L-lactic acid and the monomer unit derived from D-lactic acid is preferably about 85 mole % or more, in some embodiments about 90 mole % or more, and in some embodiments, about 95 mole % or more. Multiple polylactic acids, each having a different ratio between the monomer unit derived from L-lactic acid and the monomer unit derived from D-lactic acid, may be blended at an arbitrary percentage.

In one particular embodiment, the polylactic acid has the following general structure:

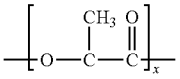

One specific example of a suitable polylactic acid polymer that may be used in the present disclosure is commercially available from Biomer, Inc. of Krailling, Germany) under the name BIOMER™ L9000. Other suitable polylactic acid polymers are commercially available from Natureworks, LLC of Minneapolis, Minn. (NATUREWORKS®) or Mitsui Chemical (LACEA™). Still other suitable polylactic acids may be described in U.S. Pat. Nos. 4,797,468; 5,470,944; 5,770,682; 5,821,327; 5,880,254; and 6,326,458, which are incorporated herein in their entirety by reference thereto for all purposes.

The polylactic acid typically has a number average molecular weight ("Mn") ranging from about 40,000 to about 160,000 grams per mole, in some embodiments from about 50,000 to about 140,000 grams per mole, and in some embodiments, from about 80,000 to about 120,000 grams per mole. Likewise, the polymer also typically has a weight average molecular weight ("Mw") ranging from about 80,000 to about 200,000 grams per mole, in some embodiments from about 100,000 to about 180,000 grams per mole, and in some embodiments, from about 110,000 to about 160,000 grams per mole. The ratio of the weight average molecular weight to the number average molecular weight ("Mw/Mn"), i.e., the "polydispersity index", is also relatively low. For example, the polydispersity index typically ranges from about 1.0 to about 3.0, in some embodiments from about 1.1 to about 2.0, and in some embodiments, from about 1.2 to about 1.8. The weight and number average molecular weights may be determined by methods known to those skilled in the art.

The polylactic acid may also have an apparent viscosity of from about 50 to about 600 Pascal seconds (Pa·s), in some embodiments from about 100 to about 500 Pa·s, and in some embodiments, from about 200 to about 400 Pa·s, as determined at a temperature of 190° C. and a shear rate of 1000 $sec^{-1}$. The melt flow index of the polylactic acid may also range from about 0.1 to about 40 grams per 10 minutes, in some embodiments from about 0.5 to about 20 grams per 10 minutes, and in some embodiments, from about 5 to about 15 grams per 10 minutes. The melt flow index is the weight of a polymer (in grams) that may be forced through an extrusion rheometer orifice (0.0825-inch diameter) when subjected to a load of 2160 grams in 10 minutes at a certain temperature (e.g., 190° C.), measured in accordance with ASTM Test Method D1238-E.

The polylactic acid also typically has a melting point of from about 100° C. to about 240° C., in some embodiments from about 120° C. to about 220° C., and in some embodiments, from about 140° C. to about 200° C. Such low melting point polylactic acids are useful in that they biodegrade at a fast rate and are generally soft. The glass transition temperature ("Tg") of the polylactic acid is also relatively low to improve flexibility and processability of the polymers. For example, the Tg may be about 80° C. or less, in some embodiments about 70° C. or less, and in some embodiments, about 65° C. or less. As discussed in more detail below, the melting temperature and glass transition temperature may all be determined using differential scanning calorimetry ("DSC") in accordance with ASTM D-3417.

In an alternative embodiment, the staple fibers may comprise regenerated cellulose fibers. Cellulosic regenerated fibers are man-made filaments obtained by extruding or otherwise treating regenerated or modified cellulosic materials from woody or non-woody plants. For example, cellulosic regenerated fibers may include rayon fibers, such as lyocell fibers, viscose fibers, or mixtures thereof, and the like. Additionally, the staple fibers can include fibers formed from natural materials such as cotton and/or wool. The staple fibers can also include bast fibers, such as those formed from jute, flax, kenaf, cannabis, linen, ramie, hemp, and combinations thereof.

In certain embodiments, the staple fibers can be formed from thermoplastic polymer materials. A wide variety of thermoplastic polymers may be used to form the staple fibers. More particularly, the staple fibers may be monocomponent, bicomponent, or multi-component fibers. Multicomponent fibers are generally formed from two or more polymers (e.g., bicomponent fibers) extruded from separate extruders. The polymers may be arranged in substantially constantly positioned distinct zones across the cross-section of the fibers. The components may be arranged in any desired configuration, such as sheath-core, side-by-side, pie, island-in-the-sea, three island, bull's eye, or various other arrangements known in the art and so forth.

Although any combination of polymers may be used, the polymers of the multicomponent fibers are typically made from thermoplastic materials with different glass transition or melting temperatures where a first component (e.g., sheath) melts at a temperature lower than a second component (e.g., core). Softening or melting of the first polymer component of the multicomponent fiber allows the multicomponent fibers to form a tacky skeletal structure, which upon cooling, stabilizes the fibrous structure. For example, the multicomponent fibers may have from about 20% to about 80%, and in some embodiments, from about 40% to about 60% by weight of the low melting polymer. Further, the multicomponent fibers may have from about 80% to about 20%, and in some embodiments, from about 60% to about 40%, by weight of the high melting polymer.

Examples of suitable thermoplastic polymers include without limitation, polyolefins, polyamides, polyesters, polylactic acid (PLA) polycarbonates, polystyrenes, thermoplastic elastomers, fluoropolymers, vinyl polymers, and blends and copolymers thereof. Suitable polyolefins include, but are not limited to, polyethylene, polypropylene, polybutylene, and the like; suitable polyamides include, but are not limited to, nylon 6, nylon 6/6, nylon 10, nylon 12 and the like; and suitable polyesters include, but are not limited to, polyethylene terephthalate, polybutylene terephthalate and the like. Particularly suitable thermoplastic polymers for use in the present disclosure are polyolefins including polyethylene, for example, linear low density polyethylene, low density polyethylene, medium density polyethylene, high density polyethylene and blends thereof; polypropylene; polybutylene and copolymers as well as blends thereof. Additionally, the suitable fiber forming polymers may have thermoplastic elastomers blended therein.

In embodiments, the staple fibers can include bicomponent fibers that are crimped. Bicomponent fibers may be either mechanically crimped or, if the appropriate polymers are used, naturally crimped. As used herein, a naturally crimped fiber is a fiber that is crimped by activating a latent crimp contained in the filaments used to form the fibers. For instance, in one embodiment, filaments can be naturally crimped by subjecting the filaments to a gas, such as a heated gas, after being drawn. The crimped filaments can be further processed in order to form crimped staple fibers. In certain embodiments, the staple fibers include crimped polyethylene terephthalate fibers, such as crimped conjugated polyethylene terephthalate fibers.

The staple fibers used in accordance with the present disclosure can include fibers having an average length of from about 5 mm to about 50 mm, such as from about 8 mm to about 40 mm, such as from about 10 mm to about 20 mm. In certain embodiments, the staple fibers can include fibers having an average length of about 18 mm. Still in certain embodiments, the staple fibers can have an average length of from about 8 mm to about 20 mm. Advantageously, the staple fibers incorporated into the coform material may include longer lengths than other staple fibers previously introduced during the coform process. Without being bound by any particular theory, incorporation of staple fibers having average lengths described herein can contribute to mechanical interlocking between the absorbent material (e.g., pulp fibers) and the staple fibers to strengthen the formed coform material.

The staple fibers can be incorporated into the coform, nonwoven web in an amount of from about 5 wt. % to about 50 wt. %, such as from about 10 wt. % to about 40 wt. %, such as from about 20 wt. % to about 30 wt. %.

II. Absorbent Material

Any absorbent material may generally be employed in the coform nonwoven web, such as absorbent fibers, particles, etc. In one embodiment, the absorbent material includes fibers formed by a variety of pulping processes, such as kraft pulp, sulfite pulp, thermomechanical pulp, etc. The pulp fibers may include softwood fibers including, but are not limited to, northern softwood, southern softwood, redwood, red cedar, hemlock, pine (e.g., southern pines), spruce (e.g., black spruce), combinations thereof, and so forth. Exemplary commercially available pulp fibers suitable for the present disclosure include those available from Weyerhaeuser Co. of Federal Way, Wash. under the designation "Weyco CF-405." Hardwood fibers, such as eucalyptus, maple, birch, aspen, and so forth, can also be used. In certain instances, eucalyptus fibers may be particularly desired to increase the softness of the web. Eucalyptus fibers can also enhance the brightness, increase the opacity, and change the pore structure of the web to increase its wicking ability. Moreover, if desired, secondary fibers obtained from recycled materials may be used, such as fiber pulp from sources such as, for example, newsprint, reclaimed paperboard, and office waste. Further, other natural fibers can also be used in the present disclosure, such as abaca, sabai grass, milkweed floss, pineapple leaf, and so forth. In addition, in some instances, synthetic fibers can also be utilized.

Besides or in conjunction with pulp fibers, the absorbent material may also include a superabsorbent that is in the form fibers, particles, gels, etc. Generally speaking, superabsorbents are water-swellable materials capable of absorbing at least about 20 times its weight and, in some cases, at least about 30 times its weight in an aqueous solution containing 0.9 weight percent sodium chloride. The superabsorbent may be formed from natural, synthetic and modified natural polymers and materials. Examples of synthetic superabsorbent polymers include the alkali metal and ammonium salts of poly(acrylic acid) and poly(methacrylic acid), poly(acrylamides), poly(vinyl ethers), maleic anhydride copolymers with vinyl ethers and alpha-olefins, poly (vinyl pyrrolidone), poly(vinylmorpholinone), poly(vinyl alcohol), and mixtures and copolymers thereof. Further, superabsorbents include natural and modified natural polymers, such as hydrolyzed acrylonitrile-grafted starch, acrylic acid grafted starch, methyl cellulose, chitosan, carboxymethyl cellulose, hydroxypropyl cellulose, and the natural gums, such as alginates, xanthan gum, locust bean gum and so forth. Mixtures of natural and wholly or partially synthetic superabsorbent polymers may also be useful in the present disclosure. Particularly suitable superabsorbent polymers are HYSORB 8800AD (BASF of Charlotte, N.C. and FAVOR SXM 9300 (available from Evonik Stockhausen of Greensboro, N.C.)

The absorbent material can include pulp fibers that are present in an amount of from about 50 wt. % to about 95 wt. % of the coform nonwoven web, such as from about 60 wt. % to about 90 wt. %, such as from about 70 wt. % to about 80 wt. % and, in certain embodiments, from about 80 wt. % to about 90 wt. % of the coform nonwoven web.

III. Thermoplastic Polymer Fibers

Optionally, the coform web of the present disclosure can include one or more thermoplastic polymer fibers, such as melt-spun fibers. The thermoplastic polymer fibers can include meltblown fibers. For instance, methods for producing meltblown fibers include continuously extruding a thermoplastic polymer (either from the melt or a solution) through a spinneret in order to form discrete fibers. Thereafter, the fibers are drawn (either mechanically or pneumatically) without breaking in order to molecularly orient the polymer fibers and achieve tenacity. Lastly, the continuous fibers are deposited in a substantially random manner in the machine direction (MD) onto a carrier belt or the like to form a web of substantially continuous and randomly arranged, molecularly oriented fibers. The meltblown fibers can have an average diameter ranging from about 1 micron to about 50 microns. For instance, the meltblown fibers can have an average diameter of less than about 40 microns, such as less than about 30 microns, such as less than about 20 microns, such as less than about 15 microns, such as less than about 10 microns, such as less than about 8 microns, such as less than about 5 microns. The meltblown fibers generally have an average fiber diameter of greater than about 1 micron, such as greater than about 2 microns. In certain embodiments, the meltblown fibers have an average fiber diameter of less than about 5 microns. The fiber size of the meltblown fibers may be controlled depending on the application. In general, the meltblown fibers are predominantly continuous.

A wide variety of thermoplastic polymers may be used to form the thermoplastic polymer fibers. More particularly, the meltblown fibers may be monocomponent, bicomponent, or multi-component fibers. Thus, materials embodying the features of the disclosure may be fashioned with different physical properties by the appropriate selection of polymers or combinations thereof for the respective material. Examples of suitable thermoplastic polymers include without limitation, polyolefins, polyamides, polyesters, polylactic acid (PLA) polycarbonates, polystyrenes, thermoplastic elastomers, fluoropolymers, vinyl polymers, and blends and copolymers thereof.

Suitable polyolefins include, but are not limited to, polyethylene, polypropylene, polybutylene, and the like; suitable polyamides include, but are not limited to, nylon 6, nylon 6/6, nylon 10, nylon 12 and the like; and suitable polyesters include, but are not limited to, polyethylene terephthalate, polybutylene terephthalate and the like. Particularly suitable thermoplastic polymers for use in the present disclosure are polyolefins including polyethylene, for example, linear low density polyethylene, low density polyethylene, medium density polyethylene, high density polyethylene and blends thereof; polypropylene; polybutylene and copolymers as well as blends thereof. Additionally, the suitable fiber forming polymers may have thermoplastic elastomers blended therein.

Although the thermoplastic fibers can be made from the same thermoplastic polymer or from polymers having the same characteristics, as described above, in one embodiment, different types of polymers may be used to form the thermoplastic polymer fibers. For example, the polymer used to produce a first thermoplastic polymer fiber can have a melt flow rate that is at least 30% greater, such as at least 50% greater, such as at least 70% greater, such as at least 100% greater, such as at least 150% greater, such as at least 200% greater, such as at least 250% greater, such as at least 300% greater, such as at least 350% greater, such as at least 400% greater than the melt flow rate of a second polymer used to form a second thermoplastic polymer fiber. The difference in melt flow rate can depend upon various factors, including the type of polymer used. When using polylactide polymers, for instance, the melt flow rate of the polymer used to produce the first thermoplastic polymer fibers can be twice as much or three times as much as the melt flow rate of the polymer used to produce the second thermoplastic polymer fiber. When using polyolefin polymers, such as polypropylene polymers, on the other hand, the polymer used to produce the first thermoplastic polymer fiber can be at least about 20% greater, such as at least about 30% greater, such as at least about 40% greater than the polymer used to produce the second thermoplastic polymer fiber.

IV. Coform Technique

The coform web of the present disclosure can be made via a process in which staple fibers are incorporated into a stream of absorbent material to form a composite stream. The composite stream can then be collected on a suitable collecting surface to form a coform nonwoven web. The coform nonwoven web on the collecting surface can then be subjected to one or more bonding processes in order to bond the coform nonwoven web, such as one or more hydroentangling processes or thermal bonding processes. The coform nonwoven web can be formed entirely by the disclosed air-formed process.

Referring to FIG. 1, a system 100 for making a coform nonwoven web of the present disclosure is provided. The system 100 enables an air-formed process suitable for forming nonwoven materials, such as coform nonwoven webs. Notably, a gas stream 102 (e.g., air) is generated and dispersed into duct 50 into which both staple fibers 104 and absorbent fibers 32 can be dispersed before being collected on a forming surface 58. Notably, the staple fibers 104 can be dispersed in the gas stream 102 at a location upstream from where the absorbent fibers 32 are dispersed in the gas stream 102. Further, gas stream 102 can be provided into duct 50 with sufficient velocity and pressure to facilitate removal of the staple fibers 104 from duct 152 and to carry the staple fibers 104 through duct 50 to be combined with absorbent fibers 32. Gas 140 can be utilized to facilitate removal of staple fibers 104 from the picker roll 132 and can blow the staple fibers 104 down duct 152 towards duct 50 to be combined with gas stream 102. Further, gas 160 can be utilized to facilitate removal of absorbent fibers 32 from the picker roll 36 and to facilitate dispersion of the absorbent fibers 32 in gas stream 102. Accordingly, at a first location 110, gas stream 102 is substantially free from fibers. At a second location 111, gas stream 102 includes only staple fibers 104. At a third location 112, gas stream 102 includes both staple fibers 104 and absorbent fibers 32. The gas stream 102 can be used to move the staple fibers 104 and absorbent fibers 32 through nozzle 44 where they can then be deposited on forming surface 58 or can be combined with one or more plastic materials, as will be further discussed with reference to FIG. 4.

To accomplish the merger of the staple fibers 104 with the absorbent fibers 32, the staple fibers 104 can be provided in the form of a mat, batt, or bale. As such, an opener 120 is utilized to open the mat, batt, or bale of staple fibers 104 and to separate the staple fiber 104 into individual staple fibers 104. For instance, the opener 120 can include a plurality of teeth configured to separate staple fibers in a mat or batt into individual staple fibers 104. Suitable openers are generally known in the art and can include rows of rollers having teeth or other mechanisms thereon for picking apart the individual fibers. The staple fibers 104 leaving the opener 120 can be subjected to processing with a second opener 122 (e.g., a preopener). Opener 120 and opener 122 can be the same opener or can be different. For example, opener 120 can include multiple teeth for separating the staple fibers 104, while opener 122 can include fewer or more teeth for further separating the staple fibers 104. For instance, since opener 120 primarily separates the staple fibers 104 from a matt or batt, it is conceivable that small clumps of staple fibers 104 may be present upon leaving opener 120. Accordingly, the second opener 122 can be utilized to further separate the staple fibers 104 and remove any remaining clumps.

Upon leaving the second opener 122, the staple fibers 104 are conveyed to a fiber tower 125. Staple fibers 104 can remain in the fiber tower 125 until they are disposed from the fiber tower 125 through nozzle 127 into fiber opener 130. Fiber opener 130 can include a picker roll 132 having a plurality of teeth 134 further configured to separate the staple fibers 104. A housing 136 encloses the picker roll 132 and provides a passageway or gap 141 between the housing 136 and the surface of the teeth 134 of the picker roll 132. A gas 140, for example, air, is supplied to the passageway or gap 141 between the surface of the picker roll 132 and the housing 136 by way of a gas duct 150. The gas is supplied in sufficient quantity to serve as a medium for conveying the staple fibers 104 into and through duct 152 towards gas stream 102 in duct 50. The gas 140 supplied also serves as an aid in removing the staple fibers 104 from the teeth 134 of the picker roll 132. The gas 140 may be supplied by any conventional arrangement such as, for example, an air blower (not shown). Notably, gas stream 102 is supplied in duct 50 in sufficient quantity to facilitate removal of the staple fibers 104 from duct 152. Duct 152 and duct 50 are joined at junction 155. At junction 155 the staple fibers 104 enter the gas stream 102 and can proceed down duct 50 in the Z direction.

Figure 2:
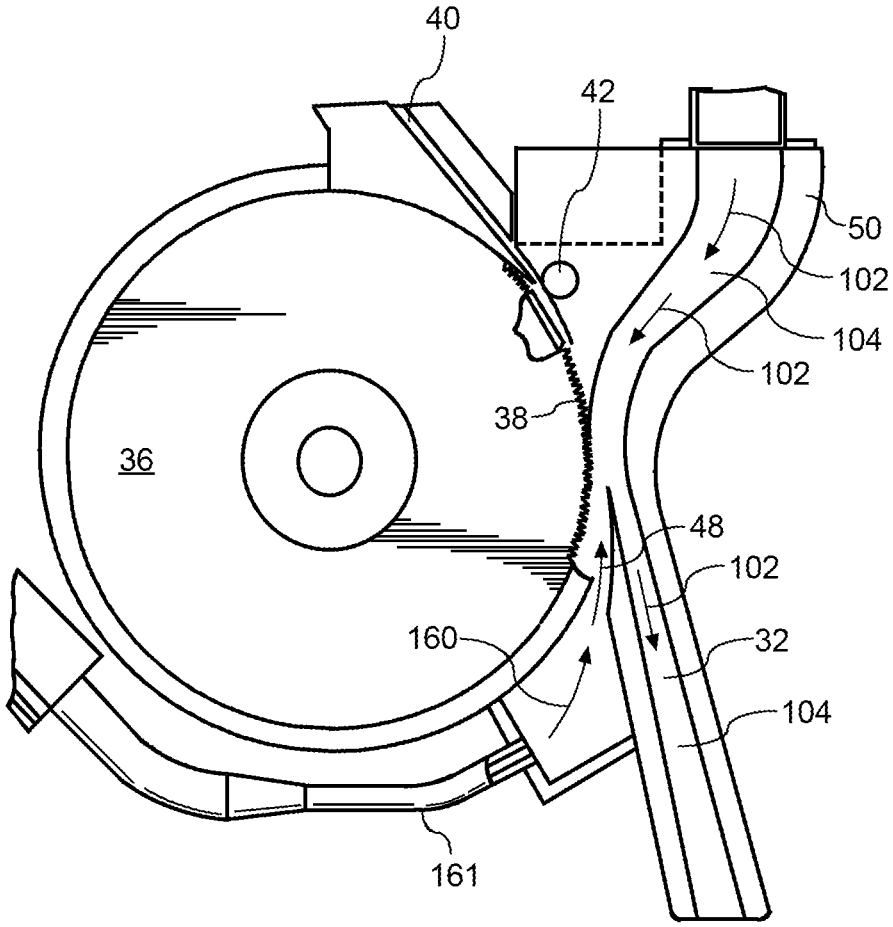
FIG. 2 is a schematic illustrating a portion of a system for forming a coform according to example embodiments of the present disclosure.

As shown in FIG. 1 and more specifically in FIG. 2, to accomplish the merger of the absorbent fibers 32 with the staple fibers 104, any conventional equipment may be employed, such as a picker roll 36 arrangement having a plurality of teeth 38 adapted to separate a mat or batt 40 of absorbent fibers 32 into the individual absorbent fibers 32. When employed, the sheets or batts 40 of fibers 32 are fed to the picker roll 36 by a roller arrangement 42. After the teeth 38 of the picker roll 36 have separated the mat of fibers into separate absorbent fibers 32, the individual absorbent fibers 32 are conveyed toward the forming surface 58 through nozzle 44. A housing 46 encloses the picker roll 36 and provides a passageway or gap 48 between the housing 46 and the surface of the teeth 38 of the picker roll 36. A gas 160 (e.g., air) is supplied to the passageway or gap 48 between the surface of the picker roll 36 and the housing 46 by way of a gas duct 161. Gas 160 provided by gas duct 161 can be supplied in sufficient quantity to aid in removing the absorbent fibers 32 from the teeth 38 of the picker roll 36. Gas 160 is also supplied in sufficient quantity to blow the absorbent fibers 32 into gas stream 102 located in duct 50. Notably, gas 160 can be used to blend the absorbent fibers 32 with staple fibers 104 present in gas stream 102. Once blended in duct 50, the staple fibers 104 and absorbent fibers 32 can move through duct 50 and into nozzle 44 where they can be deposited on forming surface 58.

To convert the composite stream 34 of absorbent fibers 32 and staple fibers 104 into a nonwoven web 54, a collecting device is located in the path of the composite stream 34. The collecting device may be a forming surface 58 (e.g., belt, drum, wire, fabric, etc.) driven by rollers 60 and that are rotating as indicated by the arrow 62 in FIG. 1. The composite stream 34 of staple fibers 104 and absorbent fibers 32 are collected as a fiber matrix on the surface of the forming surface 58 to form the nonwoven web 54. If desired, a vacuum box 170 may be employed to assist in drawing the staple fibers 104 and absorbent fibers 32 onto the forming surface 58. The forming surface 58 can carry the nonwoven web 54 for further processing.

Gases 140 and 160 and/or gas stream 102 disclosed herein can be supplied by any conventional arrangement such as, for example, an air blower or fan or air compressor (not shown). Further, an air system can be employed for the picking and forming operation which provides a controlled air movement that enhances separation of the picked fibers from the picker teeth, minimizes the development of secondary flow or vortices which could result in fiber clumping, achieves substantially uniform flow across the machine direction and transports the individual fibers through the forming duct 50 to the forming surface 58 with a substantial avoidance of fiber clumping or fiber buildup on the walls of the duct 50 and duct 152.

Additionally, it is contemplated that additives and/or other materials may be added to or entrained in gas stream 102 treat the staple fibers 104 or absorbent fibers 32. Furthermore, the quantity or velocity of gas 140 or 160 can be modified depending on the desired properties for the resultant nonwoven. For example, in certain embodiments, where additional staple fiber 104 content is desired, the quantity or velocity of gas 140 can be increased in order to introduce more staple fiber 104 into gas stream 102. Similarly, in embodiments where more absorbent fiber 32 is preferred, the quantity or velocity of gas 160 can be increased in order to introduce more absorbent fiber 32 into gas stream 102.

The internal corners of duct 50 and duct 152 can be curved to substantially prohibit the formation of low velocity stagnant areas in the corners that would enable fiber buildup. The buildup could produce fiber clumps which would eventually drop on to the forming surface 58 and detract from the uniform appearance of the nonwoven web 54. Further, the walls of duct 50 and duct 152 can be made of an electrically conductive material such as aluminum or steel so that any electrostatic field present would be substantially uniform across the interior surface of duct 50 and duct 152. The substantial uniformity of the electric field minimizes the possibility of any isolated area with increased electrostatic potential that would exert a force on the fibers and in turn steer the fibers passing through the areas to cause nonuniform formation on the forming surface 58.

Figure 3:
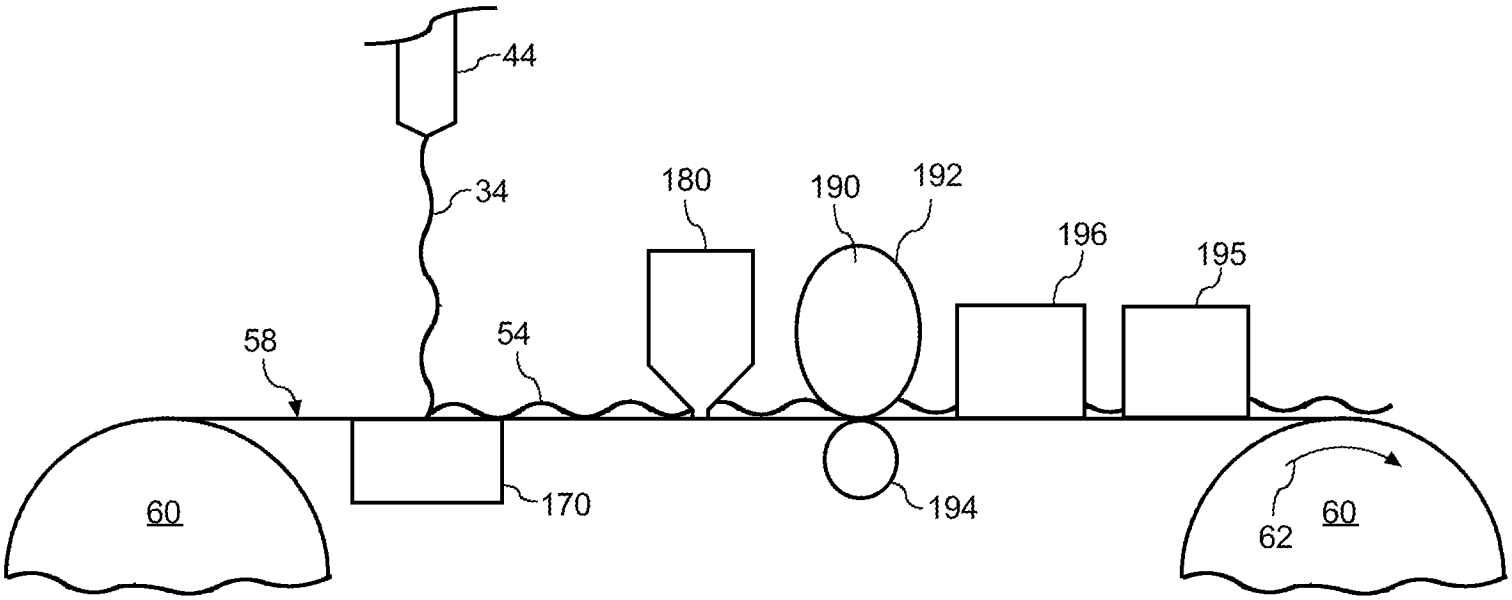
FIG. 3 is a schematic illustrating a portion of a system for forming a coform according to example embodiments of the present disclosure.

Referring now to FIG. 3, the nonwoven web 54 can be subjected to additional processing. The composite stream 34 is collected on to forming surface 58 forming the nonwoven web 54 and is carried along a path by movement of the forming surface 58 with rollers 60. Along the path, different treatments can be applied to the nonwoven web 54. For example, a hydroentangling device 180 can be used to hydroentangle the nonwoven web 54. The hydroentangling device 180 can include any conventional hydraulic entangling equipment such as may be found in, for example, in U.S. Pat. No. 3,485,706 to Evans, the disclosure of which is hereby incorporated by reference. The hydraulic entangling of the present disclosure may be carried out with any appropriate working fluid such as, for example, water. The working fluid flows through a manifold which evenly distributes the fluid to a series of individual holes or orifices.

Additionally and/or alternatively, the nonwoven web 54 can also be thermally bonded by thermal bonding device 190. For instance, the thermal bonding device 190 can include a calender roll 192 (e.g., a heated calender roll) and an anvil roll 194. The nonwoven web 54 can be further bonded between the calender roll 192 and the anvil roll 194. Optionally, the calender roll 192 can be patterned in some way so that the entire nonwoven is not bonded across its entire surface. As a result, various patterns for calender rolls 192 have been developed for functional as well as aesthetic reasons. Typically, the percent bonding area varies from around 10% to around 30% of the area of the nonwoven web 54.

Additionally and/or alternatively, the nonwoven web 54 can also be through-air bonded by a through-air bonding device 196. The through-air bonding device 196 forces air through the nonwoven web 54 in order to bond one or more of the fiber components of the nonwoven web 54. The air forced through the non-woven web 54 is sufficiently hot to bond one or more of the fiber components of the nonwoven web. Through-air bonding is further discussed hereinbelow.

The nonwoven web 54 can be dried by dryer 195 producing a finished nonwoven product. After drying, the nonwoven web 54 can be removed from the forming surface 58 and can be further processed as necessary. For instance, sheets of the nonwoven web 54 can be cut into individual sheets or can be rolled forming rolled sheet material.

Figure 4:
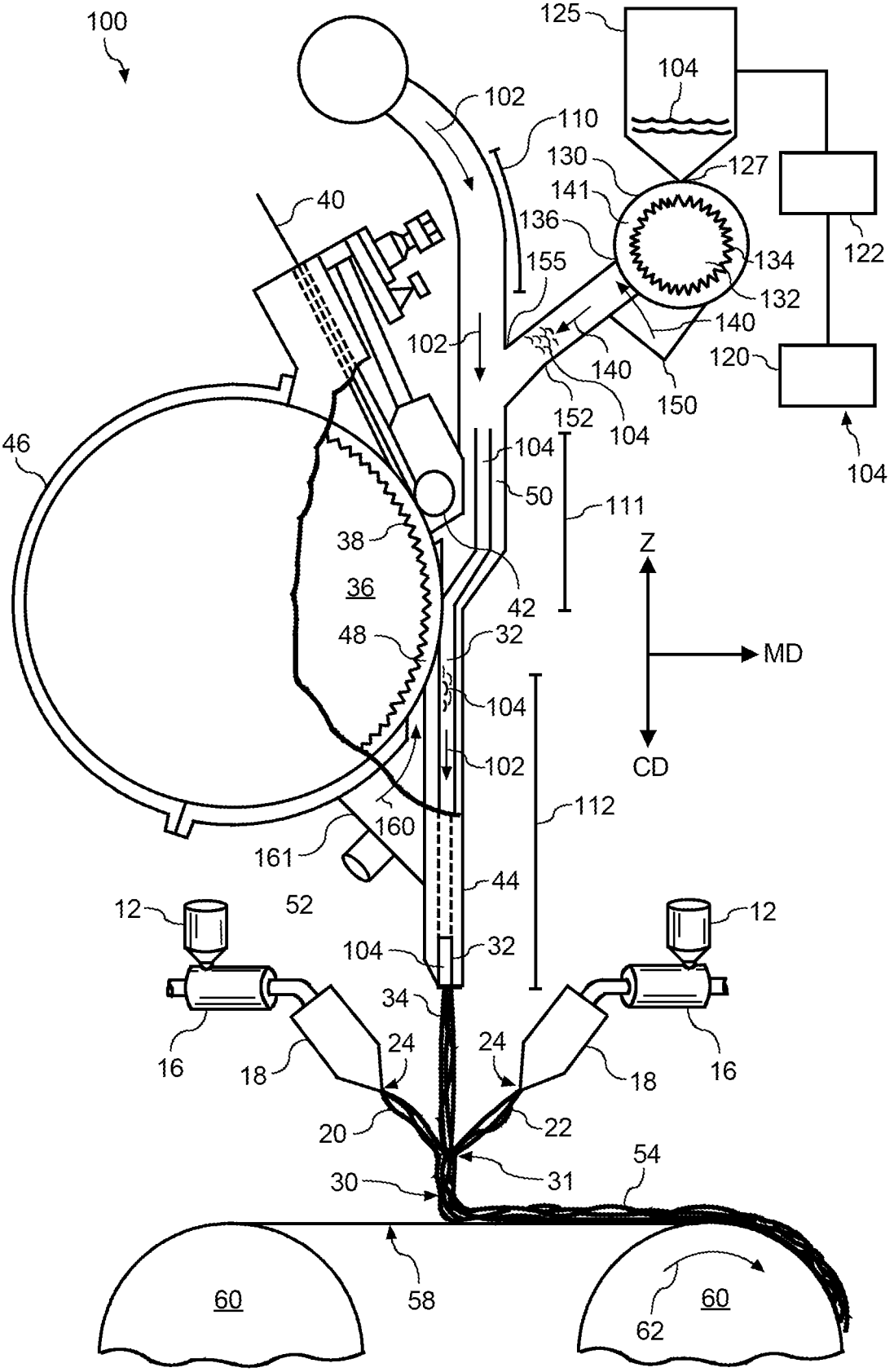
FIG. 4 is a schematic illustrating one embodiment of a system for forming a coform according to example embodiments of the present disclosure.

Now referring to FIG. 4, in certain embodiments, one or more thermoplastic polymer fibers can be incorporated into the composite stream 34 of staple fibers 104 and absorbent fibers 32. The apparatus includes extruders 16 and 16', respectively, into which a thermoplastic polymer composition may be introduced. For instance, one or more hoppers 12 can be utilized to introduce the thermoplastic polymer composition into extruders 16 and 16'. The extruders 16 and 16' can be utilized to introduce meltblown fibers into the stream of absorbent fibers 32 and staple fibers 104. The extruders 16 and 16' each have an extrusion screw (not shown), which is driven by a conventional drive motor (not shown). As the polymer advances through the extruders 16 and 16', it is progressively heated to a molten state due to rotation of the extrusion screw by the drive motor. Heating may be accomplished in a plurality of discrete steps with its temperature being gradually elevated as it advances through discrete heating zones of the extruders 16 and 16' toward two meltblowing die heads 18 and 18', respectively. The meltblowing die heads 18 and 18' may constitute another heating zone where the temperature of the thermoplastic polymer is maintained at an elevated level for extrusion.

When two or more meltblowing die heads are used, such as described above, it should be understood that the fibers produced from the individual die heads may be different types of fibers. That is, the size, shape, or polymeric composition of the meltblown fibers from die head 18 can be different from those extruded from die head 18'. For instance, in embodiments smaller fibers are produced by the first meltblowing die head 18. Thus, the first meltblowing die head 18 can have a smaller average diameter as compared to the second meltblowing die head 18'. For example, the first meltblowing die head 18 has an average diameter of about 5 micrometers or less, in some embodiments about 10 micrometers or less, and in some embodiments, from about 5 to about 50 micrometers or less in comparison with the second die head 18'. Accordingly, different sized die heads can be utilized depending on the particular diameter of thermoplastic fiber needed for the coform.

Each meltblowing die head 18 and 18' is configured so that two streams of attenuating gas per die converge to form a single stream of gas which entrains and attenuates molten threads 19 as they exit small holes or orifices 24 in each meltblowing die head, 18 and 18'. The molten threads 19 are formed into fibers or, depending upon the degree of attenuation, microfibers, of a small diameter which is usually less than the diameter of the orifices 24. Thus, each meltblowing die head 18 and 18' has a corresponding single stream of gas, such as a first gas stream 20 corresponding to die head 18 and a second gas stream 22 corresponding to die head 18'. The first gas stream 20 and the second gas stream 22 containing polymer fibers are aligned to converge at an impingement zone 31.

Absorbent fibers 32 and/or staple fibers 104 can also be added at the impingement zone 31 along with the first gas stream 20 and the second gas stream 22. Introduction of the absorbent fibers 32 and/or staple fibers 104 into the first gas stream 20 and second gas stream 22 of thermoplastic polymer fibers 30 can be configured to produce either a homogenous or graduated distribution of absorbent fibers 32 and staple fibers 104 within the combination of the first gas stream 20 and the second gas stream 22 of thermoplastic polymer fibers 30. This may be accomplished by merging composite stream 34 between the two gas streams 20 and 22 of thermoplastic polymer fibers 30 so that all three gas streams converge in a controlled manner. Because they remain relatively tacky and semi-molten after formation, the thermoplastic polymer fibers 30 may simultaneously adhere and entangle with the absorbent fibers 32 and/or staple fibers 104 upon contact therewith to form a coherent nonwoven web 54.

As shown in FIG. 4, the meltblowing die heads 18 and 18' can be arranged at a certain angle with respect to the forming surface 58, such as described in U.S. Pat. Nos. 5,508,102 and 5,350,624 to Georger et al. Each die head 18 and 18', for instance, can be set at an angle ranging from about 30 to about 90 degrees, in some embodiments from about 35 degrees to about 80 degrees, and in some embodiments from about 45 degrees to about 65 degrees. The die heads 18 and 18' may be oriented at the same or different angles. In fact, the texture of the nonwoven web 54 may actually be enhanced by orienting one die at an angle different than another die.

In one aspect, the die head 18 can be at an angle of from about 35 degrees to about 55 degrees to the forming surface 58 so that the thermoplastic polymer fibers 30, absorbent fibers 32, and staple fibers 104 experience robust mixing. The die head 18', on the other hand, can be at an angle of from about 70 degrees to about 90 degrees so that very little mixing occurs between the absorbent fibers 32, staple fibers 104, and the thermoplastic polymer fibers 30. In this manner, the thermoplastic polymer fibers 30 are free to have greater fiber to fiber bonds, which can further enhance cross-directional strength.

Components or devices of the system 100 can be controlled using a controller (not shown). For instance, to control air flow through the system 100, controller can be used to control the amount or velocity of air stream 102, gas 140, and/or gas 160. Additionally, the controller can be used to control rotation of picker rolls 36 and 132. The controller can also be used to control the speed of rotation of rollers 60. The controller can also be used to control the hydroentangling device 180, thermal bonding device 190, and/or dryer 195. The controller can include one or more processors and one or more memory devices. The one or more memory devices can store computer-readable instructions that, when executed by the one or more processors, cause the one or more processors to perform operations such as any of the control operations described herein.

Figure 5:
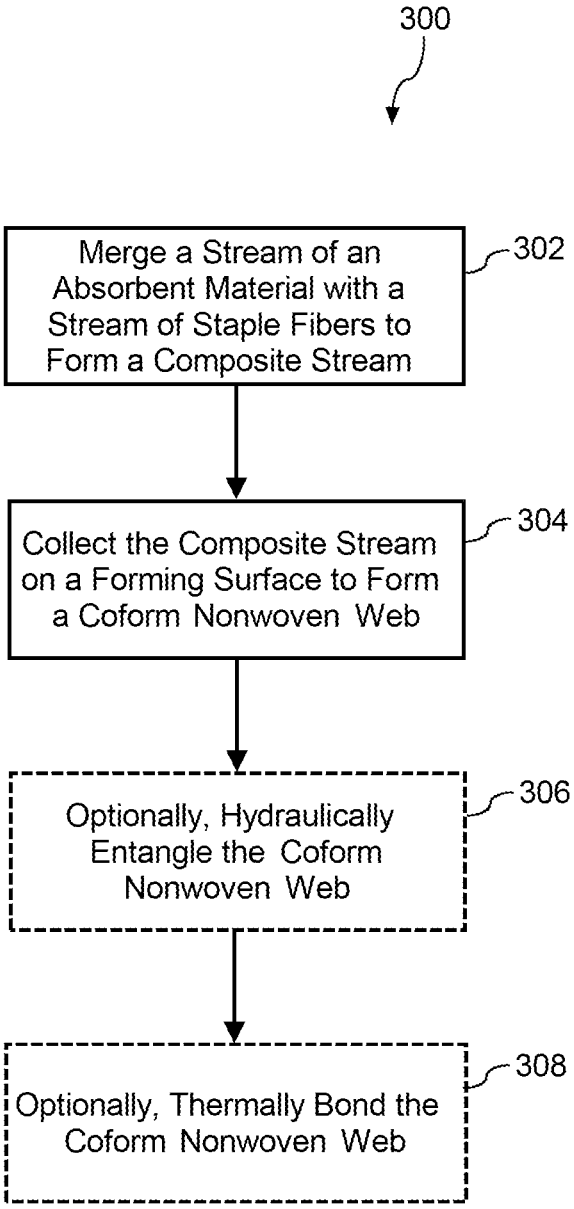
FIG. 5 is a flow chart of one embodiment of a process for producing coform nonwoven web material according to example embodiments of the present disclosure.

FIG. 5 illustrate an example flowchart process of a method (300) that can be utilized to form the coform material as disclosed herein. Briefly, at (302) the method (300) includes merging a stream of an absorbent material (e.g., pulp fibers) with a stream of staple fibers to form a composite stream. For example, in certain embodiments, one or more streams of staple fibers can be blown into the absorbent material stream to create a composite stream. Still, in other embodiments, it is contemplated that absorbent material and staple fibers can be combined in a forming chamber and can be provided in a stream from the collecting device and laid onto a collecting surface to form the coform nonwoven web.

At (304) the method includes collecting the composite stream on a forming surface to form a coform nonwoven web. For example, the composite stream is disposed on a moving foraminous surface (e.g., forming surface), such as a forming screen. A vacuum source can be employed to draw an air stream through the forming surface. The air stream deposits the fibers and/or particulate material onto the moving forming surface. Once the fibers are deposited onto the forming surface, a web of the coform material is formed.

Optionally, at (306) the method includes hydraulically entangling the coform nonwoven web. For example, the nonwoven web can be subjected to a first hydroentangling process by applying hydraulic energy to a first side of the web. The nonwoven web can then be subjected to a second hydroentangling process by applying hydraulic energy to a second and opposite side of the web. If desired, further hydraulically entangling processes can be carried out on the first side, on the second side or on both sides. Hydraulic entangling may also be used to impart a textured pattern on the material to improve overall thickness of the coform material.

The hydraulic entangling may be accomplished utilizing conventional hydraulic entangling equipment such as may be found in, for example, in U.S. Pat. No. 3,485,706 to Evans, the disclosure of which is hereby incorporated by reference. The hydraulic entangling of the present disclosure may be carried out with any appropriate working fluid such as, for example, water. The working fluid flows through a manifold which evenly distributes the fluid to a series of individual holes or orifices. These holes or orifices may be from about 60 microns to about 200 microns in diameter, such as from about 100 microns to about 140 microns in diameter. For example, the disclosure may be practiced utilizing a manifold containing a strip having 120 micron diameter orifices with a spacing of 600 microns and 1 row of holes. In other embodiments, the manifold includes at least 2 roles of holes, such as at least three rows of holes, such as at least four rows of holes, such as at least five rows of holes, such as at least 6 rows of holes, such as at least 7 rows of holes, such as at least 8 rows of holes, etc. Many other manifold configurations (e.g., several manifolds arranged in succession) and combinations may be used.

In the hydraulic entangling process, the working fluid passes through the orifices at a pressures ranging from about 200 to about 4000 pounds per square inch gage (psig). In certain embodiments, the mean pressure applied during the hydroentangling process if from about 20 Bar to about 200 Bar, such as from about 80 Bar to about 120 Bar. The fluid impacts the nonwoven web which is supported by a foraminous surface which may be, for example, a single plane mesh having a mesh size of from about 40×40 to about 120×120. As is typical in many water jet treatment processes, vacuum slots may be located directly beneath the hydro-needling manifolds or beneath the foraminous entangling surface downstream of the entangling manifold so that excess water is withdrawn from the hydraulically entangled nonwoven material.

The columnar jets of working fluid which directly impact fibers of the nonwoven web work to entangle the fibers and form a more coherent structure. The pulp fibers are entangled with the staple fibers of the nonwoven web and with each other.

In accordance with the present disclosure, the nonwoven web can be subjected to a single hydroentangling step or multiple hydroentangling steps. In one embodiment, only one side of the nonwoven web is subjected to hydroentangling. While, in another embodiment, a first side of the nonwoven web is subjected to sufficient amounts of hydraulic energy to cause hydroentangling within the web. The second side or opposite side of the nonwoven web can then be subjected to a hydroentangling process in which hydraulic energy is applied to the second side for hydroentangling to occur. In one embodiment, the nonwoven web can be subjected to further hydroentangling processes. For instance, each side of the nonwoven web can be subjected to two or more hydroentangling processes. In one particular embodiment, for instance, the first side of the web is subjected to one to three hydroentangling processes and the second side of the web is subjected to one to three hydroentangling processes. The number of hydroentangling processes carried out on each side of the web can be the same or different. In one particular embodiment, for instance, the first side of the web may be subjected to two hydroentangling processes while the opposite and second side of the web may be subjected to a single hydroentangling process. The second side of the web, for instance, can be subjected to a hydroentangling process in between subjecting the first side of the web to two different hydroentangling steps.

After the plurality of fluid jet treatments, the nonwoven web may be dewatered, such as via vacuum dewatering, to prepare the web for drying. The drying may be performed using various methods known in the art such as through-air drying, infrared drying, impingement drying, conduction drying, and the like. In one embodiment, the drying is a non-compressive form of drying in order to maintain the thickness of the web and the absorbent capacity.

Additional hydroentangling treatments can be performed in order to apply textures or patterns to the resulting nonwoven web and/or to improve overall strength or thickness of the nonwoven web.

Further, optionally, at (308) the method includes thermally bonding the coform nonwoven web. Thermal bonding can be achieved by employing various drying techniques known in the art, such as through-air drying (i.e., through-air bonding), infrared drying, or impingement drying. In one embodiment, the nonwoven web can be fed through a through-air dryer at a temperature that causes thermal bonding to occur. Through-air drying the web bonds the fibers without significant compressive forces and thus maintains the bulk and absorbency characteristics of the web.

As used herein, through-air bonding or "TAB" means a process of bonding a nonwoven fiber web in which air, which is sufficiently hot to bond one or more of the fiber components of the nonwoven web, is forced through the web. The air velocity is between 100 and 500 feet per minute and the dwell time may be as long as 10 seconds. Typically, through-air bonding has relatively restricted variability, since through-air bonding typically requires the melting of at least one component to accomplish bonding. Accordingly, through-air bonding is generally restricted to webs with two components. In one type of through-air bonder, air having a temperature above the melting temperature of one component and below the melting temperature of another component is directed from a surrounding hood, through the web, and into a perforated roller supporting the web.

Alternatively, the through-air bonder may be a flat arrangement wherein the air is directed vertically downward onto the web. The operating conditions of the two configurations are similar, the primary difference being the geometry of the web during bonding. The hot air melts the lower melting component and thereby forms bonds between the fibers to integrate the web.

In certain embodiments, thermal bonding of the coform nonwoven material can include thermal point bonding of the material. As used herein "thermal point bonded" means bonding one or more materials with a pattern of discrete bond points. As an example, thermal point bonding often involves passing a fabric or web of fibers to be bonded through a nip between a pair of heated bonding calender rolls. One of the bonding rolls is usually, though not always, patterned in some way so that the entire fabric is not bonded across its entire surface, and the second or anvil roll is usually a smooth surface. As a result, various patterns for calender rolls have been developed for functional as well as aesthetic reasons. One example of a pattern has points and is the Hansen Pennings or "H&P" pattern with about a 30% bond area with about ~200 bonds/square inch as taught in U.S. Pat. No. 3,855,046 to Hansen and Pennings. The H&P pattern has square point or pin bonding areas wherein each pin has a side dimension of 0.038 inches (0.965 mm), a spacing of 0.070 inches (1.778 mm) between pins, and a depth of bonding of 0.023 inches (0.584 mm). The resulting pattern has a bonded area of about 29.5%. Another typical point bonding pattern is the expanded Hansen Pennings or "EHP" bond pattern which produces a 15% bond area with a square pin having a side dimension of 0.037 inches (0.94 mm), a pin spacing of 0.097 inches (2.464 mm) and a depth of 0.039 inches (0.991 mm). Another typical point bonding pattern designated "714" has square pin bonding areas wherein each pin has a side dimension of 0.023 inches, a spacing of 0.062 inches (1.575 mm) between pins, and a depth of bonding of 0.033 inches (0.838 mm). The resulting pattern has a bonded area of about 15%. Yet another common pattern is the C-Star pattern which has a bond area of about 16.9%. The C-Star pattern has a cross-directional bar or "corduroy" design interrupted by shooting stars. Other common patterns include a diamond pattern with repeating and slightly offset diamonds with about a 16% bond area and a wire weave pattern, having generally alternating perpendicular segments, with about a 19% bond area. Typically, the percent bonding area varies from around 10% to around 30% of the area of the fabric laminate web. Point bonding may be used to hold the layers of a laminate together and/or to impart integrity to individual layers by bonding filaments and/or fibers within the web.

In certain embodiments, the coform nonwoven web can be exposed to one or more hydroentangling processes or one or more thermal bonding processes.

In one embodiment, the coform nonwoven web only contains the staple fibers and the pulp fibers and does not contain any other fibers. In fact, in one embodiment, the nonwoven web is only made from the staple fibers and the pulp fibers and may contain no other fillers, particles, fibers, and the like. Furthermore, in embodiments the coform nonwoven web is substantially free from thermoplastic polymer materials. While in other embodiments, polymer staple fibers or additional thermoplastic polymer fibers (e.g., meltblown fibers) can be incorporated into the coform nonwoven web.

Furthermore, in certain embodiments, it may be desirable to use finishing steps and/or post treatment processes generally employed in the art to impart selected properties to the coform nonwoven web material. For example, additional layers or materials can be added to the coform nonwoven web in order to impart selected properties.

The air-forming process of the present disclosure is suitable for forming coform materials having desired strength and softness, without resorting to the use of perforated air cylinders, as in the air-laid process, or additional combing or carding units as required by carded processes. Notably, the coform materials formed by the air-forming process disclosed herein include staple fibers and absorbent materials and have improved strength and softness as compared to nonwovens formed via other processes.

The basis weight of coform material made in accordance with the present disclosure can vary depending upon various factors including the intended use of the product. In general, the basis weight is greater than about 10 gsm, such as greater than about 15 gsm, such as greater than about 20 gsm, such as greater than about 25 gsm, such as greater than about 30 gsm, such as greater than about 40 gsm. The basis weight of the wiper product is generally less than about 300 gsm, such as less than about 250 gsm, such as less than about 200 gsm, such as less than about 175 gsm, such as less than about 150 gsm, such as less than about 125 gsm, such as less than about 110 gsm, such as less than about 100 gsm, such as less than about 90 gsm.

Additionally, the coform material can have a mean cup crush energy of from about 110 gf*mm to about 850 gf*mm, such as from about 200 gf*mm to about 800 gf*mm. The coform material can have a mean cup crush peak of from about 5 gf to about 60 gf, such as from about 15 gf to about 50 gf, such as from about 20 gf to about 40 gf. In other embodiments, the coform material can have a mean cup crush energy of from about 1000 gf*mm to about 2800 gf*mm, such as from about 1200 gf*mm to about 2200 gf*mm. The coform material can have a mean cup crush peak of from about 60 gf to about 200 gf, such as from about 75 gf to about 150 gf.

The coform material can include a mean machine direction (MD) tensile strength of from about 400 gf/inch to about 2500 gf/inch, such as from about 1000 gf/inch to about 2000 gf/inch, such as from about 1200 gf/inch to about 1700 gf/inch. The coform material can have a mean MD elongation % of from about 25% to about 40%. In certain embodiments, the coform material can include a mean machine direction (MD) tensile strength of from about 350 gf/inch to about 700 gf/inch, such as from about 400 gf/inch to about 650 gf/inch. The coform material can have a mean MD elongation % of from about 10% to about 20%.

The coform material can have a mean cross direction (CD) tensile strength of from about 250 gf/inch to about 1250 gf/inch, such as from about 750 gf/inch to about 100 gf/inch. The coform material can have a mean CD elongation % of from about 50% to about 75%. The coform material can have a mean cross direction (CD) tensile strength of from about 225 gf/inch to about 375 gf/inch, such as from about 250 gf/inch to about 350 gf/inch. The coform material can have a mean CD elongation % of from about 30% to about 60%.

Surprisingly, the coform material according to the present disclosure also exhibits excellent softness. For instance, in one aspect, a nonwoven web according to the present disclosure exhibits a TS7 value of about 8 or less, such as about 7 or less, such as about 6 or less, such as about 5.5 or less, such as about 5 or less, such as about 4.5 or less, such as about 4 or less, such as about 3.5 or less, such as about 3 or less, such as about 2.5 or less, or any ranges or values therebetween. As used herein, the terms "TS7" and "TS7 value" refer to an output of an EMTEC Tissue Softness Analyzer ("TSA") (Emtec Electronic GmbH, Leipzig, Germany) as described in the Test Methods section. The units of the TS7 value are dB V2 rms, however, TS7 values are often referred to herein without reference to units.

Once the coform nonwoven material is produced, the coform material can be further processed and packaged as a wiper product. For example, in one embodiment, the coform nonwoven web can be cut into individual sheets. The sheets can be interfolded and packaged into a dispenser. The wiper product can include individual wipes that are interfolded and arranged in a stack. The stack of wipers can be contained in and stored in a dispenser for dispensing the wipers one at a time. Additional material layers or additional layers of the coform material can be added to provide a laminated product having at least one layer of the coform material disclosed therein.

In one embodiment, the wiper or wiper product including the coform nonwoven web can be pre-moistened or pre-impregnated with a solvent, such as a cleaning solvent, prior to being packaged. The solvent may comprise any suitable solvent based upon the end use application of the wiper. In one embodiment, for instance, the solvent may comprise water. In certain embodiments, the solvent can include a cleaning solution, having one or more agents dispersed therein that are known to be used in household or industrial cleaning products. For example, one or more sanitizing agents or disinfectants can be included. Furthermore, for personal care products, the wipe can be impregnated with a solvent including anti-infectives such as antibiotics, antimicrobials and fungicides, antiperspirants, deodorants, sunscreens, emollients, humectants and insect repellants. For certain environmental uses in the home or for agricultural, food service, veterinary or medical applications, the wipes can be impregnated with functional agents including a wax or polish, fragrance, a disinfectant, or an insecticide. In certain embodiments, the solvent may comprise a volatile organic compound. Examples of solvents include a ketone, an alcohol, or other organic solvents, such as an ester-based solvent and hydrocarbon-based solvents (e.g., benzene, xylene, toluene, etc.). In one embodiment, the solvent may comprise isopropyl alcohol and naptha. In an alternative embodiment, the solvent may contain dipropylene glycol monomethylether.

Additionally, or alternatively, the coform material can be used to form other articles such as absorbent articles. For instance the coform material can be combined with other material layers to form absorbent articles such as personal care absorbent articles, such as diapers, training pants, absorbent underpants, incontinence articles, feminine hygiene products (e.g., sanitary napkins), swim wear, baby wipes, mitt wipe, and so forth; medical absorbent articles, such as garments, fenestration materials, underpads, bedpads, bandages, absorbent drapes, and medical wipes; food service wipers; clothing articles; pouches, and so forth.

The following test methods were used in the Examples provided hereinbelow.

Cup Crush Test

The stiffness of a nonwoven web material may be measured according to the "cup crush" test. The cup crush test evaluates fabric stiffness by measuring the peak load (also called the "cup crush load" or just "cup crush") required for a 4.5 cm diameter hemispherically shaped foot to crush a 23 cm by 23 cm piece of fabric shaped into approximately 6.5 cm diameter by 6.5 cm tall inverted cup while the cup shaped fabric is surrounded by an approximately 6.5 cm diameter cylinder to maintain a uniform deformation of the cup shaped fabric. An average of 10 readings is used. The foot and the cup are aligned to avoid contact between the cup walls and the foot which could affect the readings. The peak load is measured while the foot is descending at a rate of about 0.25 inches per second (380 mm per minute) and is measured in grams. The cup crush test also yields a value for the total energy required to crush a sample (the cup crush energy) which is the energy from the start of the test to the peak load point, i.e. the area under the curve formed by the load in grams on the one axis and the distance the foot travels in millimeters on the other. Cup crush energy is therefore reported in g*mm. Lower cup crush values indicate a softer nonwoven. A suitable device for measuring cup crush is a model FTD-G-500 load cell (500 gram range) available from the Schaevitz Company of Pennsauken, N.J.

Strength Tests

The "machine direction (MD) tensile strength" is the peak load per 1 inch (25.4 mm) of sample width when a sample is pulled to rupture in the machine direction. Similarly, the "cross-machine direction (CD) tensile strength" is the peak load per 1 inch (25.4 mm) of sample width when a sample is pulled to rupture in the cross-machine direction. The "stretch" is the percent elongation of the sample at the point of rupture during tensile testing. The instrument used for measuring tensile strengths is an MTS Systems Sintech 11S, Serial No. 6233. The data acquisition software is MTS TestWorks® for Windows Ver. 3.10 (MTS Systems Corp., Research Triangle Park, N.C.). The load cell is selected from either a 50 Newton or 100 Newton maximum, depending on the strength of the sample being tested, such that the majority of peak load values fall between 10-90% of the load cell's full scale value. The gauge length between jaws is 4±0.04 inches (101.6±1 mm). The jaws are operated using pneumatic-action and are rubber coated. The minimum grip face width is 3 inches (76.2 mm), and the approximate height of a jaw is 0.5 inches (12.7 mm). The crosshead speed is 10±0.4 inches/min (254±1 mm/min), and the break sensitivity is set at 65%. The sample is placed in the jaws of the instrument, centered both vertically and horizontally. The test is then started and ends when the specimen breaks. The peak load expressed in grams-force is recorded as either the "MD tensile strength" or the "CD tensile strength" of the specimen depending on direction of the sample being tested. At least six (6) representative specimens are tested for each product or sheet, taken "as is", and the arithmetic average of all individual specimen tests is either the MD or CD tensile strength for the product or sheet.

TS7

TS7 and TS750 values were measured using an EMTEC Tissue Softness Analyzer ("TSA") (Emtec Electronic GmbH, Leipzig, Germany) The TSA comprises a rotor with vertical blades which rotate on the test piece applying a defined contact pressure. Contact between the vertical blades and the test piece creates vibrations, which are sensed by a vibration sensor. The sensor then transmits a signal to a PC for processing and display. The signal is displayed as a frequency spectrum. For measurement of TS7 and TS750 values the blades are pressed against sample with a load of 100 mN and the rotational speed of the blades is 2 revolutions per second.

To measure TS7 and TS750 values two different frequency analyses are performed. The first frequency analysis is performed in the range of approximately 200 Hz to 1000 Hz, with the amplitude of the peak occurring at 750 Hz being recorded as the TS750 value. The TS750 value represents the surface smoothness of the sample. A high amplitude peak correlates to a rougher surface. A second frequency analysis is performed in the range from 1 to 10 KHZ, with the amplitude of the peak occurring at 7 kHz being recorded as the TS7 value. The TS7 value represents the softness of sample. A lower amplitude correlates to a softer sample. Both TS750 and TS7 values have the units dB $V^2$ rms.

Example 1

Different coform materials were made in accordance with the present disclosure and were tested for various properties. The coform materials were made from a fiber furnish containing staple fibers combined with pulp fibers. The staple fibers were present in amounts of from about 10 wt. % to about 40 wt. % and the pulp fibers were present in amounts of from about 60 wt. % to about 90 wt. %. The staple fibers included lyocell fibers having an average length of 18 mm. The coform materials were subjected to hydroentangling. The coform materials were formed according to the disclosure provided herein.

TABLE 1

| Name | Wt. % staple fiber | Wt. % pulp fiber | Mean (dry basis weight) GSM | Mean hydroentangling pressure applied (Bar) |
|---|---|---|---|---|
| Sample M 1-80 | 10 | 90 | 63.53099 | 80 |
| Sample M 2-80 | 20 | 80 | 60.08654 | 80 |
| Sample M 3-80 | 20 | 80 | 68.88903 | 80 |
| Sample M 3-100 | 20 | 80 | 73.09891 | 100 |
| Sample M 3-120 | 20 | 80 | 73.86435 | 120 |
| Sample M 3TX-60 | 20 | 80 | 72.7 | 60 |
| Sample M 3TX-80 | 20 | 80 | 72.3 | 80 |
| Sample M 4-80 | 20 | 80 | 79.98781 | 80 |
| Sample M 4-100 | 20 | 80 | 85.34585 | 100 |
| Sample M 4-120 | 20 | 80 | 71.95076 | 120 |
| Sample M 5-80 | 40 | 60 | 42.86428 | 80 |
| Sample M 5-100 | 40 | 60 | 44.01243 | 100 |
| Sample M 5-120 | 40 | 60 | 43.62972 | 120 |

Sample M 3TX-60 and Sample M 3TX-80 were subjected to an additional hydroentangling over a drum with a pattern to produce additional texture on the nonwoven coform material.

Results of the cup crush test for the Samples identified in Table 1 are shown below in Table 2.

TABLE 2

| Name | Mean Cup Crush Energy (gf * mm) | Mean cup crush peak (gf) |
|---|---|---|
| Sample M 1-80 | 373.332 | 23.838 |
| Sample M 2-80 | 374.154 | 22.272 |
| Sample M 3-80 | 433.03 | 23.274 |
| Sample M 3-100 | 454.328 | 25.734 |
| Sample M 3-120 | 556.652 | 36.362 |
| Sample M 3TX-60 | 576.994 | 32.172 |
| Sample M 3TX-80 | 327.862 | 18.55 |
| Sample M 4-80 | 663.314 | 37.634 |
| Sample M 4-100 | 834.538 | 47.172 |
| Sample M 4-120 | 501.898 | 28.942 |
| Sample M 5-80 | 167.502 | 10.984 |
| Sample M 5-100 | 122.182 | 7.592 |
| Sample M 5-120 | 138.876 | 8.78 |

Results of the strength test for the Samples identified in Table 1 are shown below in Table 3.

TABLE 3

| Name | Mean (MD Tensile) gf/inch | Mean (MD Elongation), % | Mean (CD Tensile) gf/inch | Mean (CD Elongation), % |
|---|---|---|---|---|
| Sample M 1-80 | 841.68 | 35.91 | 562.06 | 63.704 |
| Sample M 2-80 | 1397.1 | 34.576 | 562.84 | 61.238 |
| Sample M 3-80 | 966.44 | 35.212 | 567.6 | 64.182 |
| Sample M 3-100 | 2019.48 | 33.51 | 1015.98 | 57.382 |
| Sample M 3-120 | 2344.6 | 35.508 | 1214.16 | 56.316 |
| Sample M 3TX-60 | 1708.96 | 28.672 | 1025.12 | 60.382 |
| Sample M 3TX-80 | 1455.26 | 28.638 | 552.78 | 63.174 |
| Sample M 4-80 | 1439.38 | 38.288 | 732 | 58.718 |
| Sample M 4-100 | 1979.72 | 36.58 | 1144.86 | 52.68 |
| Sample M 4-120 | 1569.04 | 37.4 | 877.36 | 60.258 |
| Sample M 5-80 | 610.04 | 34.422 | 295.82 | 67.768 |
| Sample M 5-100 | 552.74 | 31.566 | 634.64 | 64.768 |
| Sample M 5-120 | 934.52 | 30.422 | 367.04 | 70.734 |

Example 2

Different coform materials were made in accordance with the present disclosure and were tested for various properties. For instance, Samples 1-14 correspond to various coform materials, while Sample 15 corresponds to a 100% airlaid, pulp fiber material not formed by the coform process of the present disclosure. The various coform materials were made as provided in Table 4 below. Briefly, the coform materials include meltblown fibers, pulp fibers, and staple fibers. The staple fibers were present in amounts from about 0 wt. % to about 20 wt. %. The pulp fibers were present in amounts of from about 40 wt. % to about 75 wt. %. The meltblown fibers were present in amounts of 27 wt. % or 22.53 wt. %. The coform materials of Samples 1-14 were formed according to the disclosure provided herein.

TABLE 4

| Name | Wt. % staple fiber | Type of staple fiber | Staple fiber length | Wt. % pulp fiber | Wt. % meltblown |
|---|---|---|---|---|---|
| Sample 1 | 0 | N/a | n/a | 73 | 27 |
| Sample 2 | 0 | n/a | n/a | 73 | 27 |
| Sample 3 | 10 | Cellluose | 18 | 63 | 27 |
| Sample 4 | 20 | Cellluose | 18 | 53 | 27 |
| Sample 5 | 30 | Cellluose | 18 | 43 | 27 |
| Sample 6 | 20 | Kinked PET | 32 | 53 | 27 |
| Sample 7 | 16.67 | Kinked PET | 32 | 60.8 | 22.53 |
| Sample 8 | 0 | n/a | n/a | 73 | 27 |
| Sample 9 | 0 | n/a | n/a | 73 | 27 |
| Sample 10 | 10 | Cellulose | 18 | 63 | 27 |
| Sample 11 | 20 | Cellulose | 18 | 53 | 27 |
| Sample 12 | 30 | Cellulose | 18 | 43 | 27 |
| Sample 13 | 20 | Kinked PET | 32 | 53 | 27 |
| Sample 14 | 16.67 | Kinked PET | 32 | 60.8 | 22.53 |
| Sample 15 | 0 | n/a | n/a | 100 | 0 |

Samples 1-7 were not subjected to any embossing, while samples 8-14 were subjected to additional embossing resulting in pattern thereon. Samples 8-14 were subjected to embossing and have a bonded area of about 23% of the total surface area of the nonwoven. The embossing pattern is a diamond-shaped pattern with each corner having a rounded corner. The interior of the diamond-shaped patterns are thicker as compared to the bonded areas. Sample 15, the airlaid web, was subjected to anvil processing resulting in a patterned web.

Results of the cup crush test and TS7 for the Samples identified in Table 4 are shown below in Table 5.

TABLE 5

| Name | Mean Cup Crush Energy (gf * mm) | Mean cup crush peak (gf) | TS7 | TS750 |
|---|---|---|---|---|
| Sample 1 | 1246.09 | 76.02 | 5.20 | 15.97 |
| Sample 2 | 1193.06 | 75.46 | 5.23 | 15.31 |
| Sample 3 | 1517.33 | 96.57 | 5.21 | 14.04 |
| Sample 4 | 1302.17 | 85.55 | 5.58 | 13.51 |
| Sample 5 | 1271.58 | 83.12 | 4.77 | 10.89 |
| Sample 6 | 1151.25 | 75.2 | 5.39 | 10.70 |
| Sample 7 | 1409.24 | 97.62 | 5.19 | 11.41 |
| Sample 8 | 2274.97 | 127.95 | 8.03 | 44.52 |
| Sample 9 | 2087.35 | 119.6 | 8.14 | 40.16 |
| Sample 10 | 2613.52 | 142.8 | 7.69 | 38.97 |
| Sample 11 | 2641.05 | 153.97 | 7.63 | 36.51 |
| Sample 12 | 2296.39 | 134.19 | 7.52 | 34.97 |
| Sample 13 | 1740.63 | 106.68 | 7.36 | 35.80 |
| Sample 14 | 2073.07 | 120.94 | 6.74 | 36.35 |
| Sample 15 | 12074.37 | 663.7 | 16.79 | 74.66 |

Results of the strength test for the Samples identified in Table 4 are shown below in Table 6.

TABLE 6

| Name | Mean (MD Tensile) gf/inch | Mean (MD Elongation), % | Mean (CD Tensile) gf/inch | Mean (CD Elongation), % | Thickness |
|---|---|---|---|---|---|
| Sample 1 | 404 | 20.87 | 271.2 | 51.68 | 0.888 |
| Sample 2 | 431 | 17.45 | 268.7 | 56.83 | 0.908 |
| Sample 3 | 336.4 | 18.38 | 270.8 | 52.67 | 1.172 |
| Sample 4 | 421.8 | 15.58 | 263.9 | 49.06 | 1.040 |
| Sample 5 | 393 | 15.17 | 275.8 | 49.58 | 1.188 |
| Sample 6 | 389.1 | 18.4 | 248.3 | 47.27 | 1.248 |
| Sample 7 | 367.3 | 16.52 | 255 | 49.45 | 1.362 |
| Sample 8 | 559.2 | 14.24 | 331.7 | 38.43 | 0.640 |
| Sample 9 | 589.6 | 14.37 | 289.6 | 36.03 | 0.612 |
| Sample 10 | 612.6 | 13.03 | 344.9 | 34.9 | 0.706 |
| Sample 11 | 657.5 | 15.71 | 340.3 | 38.84 | 0.702 |
| Sample 12 | 603.8 | 13.17 | 337.3 | 32.16 | 0.686 |
| Sample 13 | 435.4 | 17.2 | 263.9 | 40.02 | 0.808 |
| Sample 14 | 413.7 | 16.52 | 271.5 | 39.79 | 0.966 |
| Sample 15 | 3406 | 13.04 | 2664.9 | 14.78 | 0.914 |

Further aspects are provided by the subject matter of the following clauses:

1. A coform material comprising: a nonwoven web containing a mixture of staple fibers and an absorbent material including pulp fibers, the staple fibers being present in the nonwoven web in an amount of from about 5 wt. % to about 50 wt. %, the pulp fibers being present in the nonwoven web in an amount of from about 50 wt. % to about 95 wt. %, wherein the staple fibers have an average length of from about 5 mm to about 50 mm, wherein the staple fibers and pulp fibers are thermally bonded or hydraulically entangled to form the nonwoven web.
2. The coform material of any preceding clause, wherein the staple fibers are present in an amount of 5 wt. % to about 25 wt. % and the pulp fibers are present in an amount of from about 80 wt. % to about 95 wt. %.
3. The coform material of any preceding clause, wherein the staple fibers comprise regenerated cellulose, viscose rayon, cotton, wool, or combinations thereof.
4. The coform material of clause 1 or 2, wherein the staple fibers comprise crimped polyethylene terephthalate fibers.
5. The coform material of any preceding clause, wherein the staple fibers have an average length of at least about 10 mm up to about 40 mm.
6. The coform material of any preceding clause, wherein the staple fibers are present in the nonwoven web in an amount of about 30 wt. % or less.
7. The coform material of clauses 1-3 or 5-6, wherein the coform material is substantially free from thermoplastic polymer materials.
8. The coform material of clauses 1-6, further comprising meltblown fibers.
9. The coform material of any preceding clause, having a TS7 softness value of about 8 or less, measured as an output of an EMTEC Tissue Softness Analyzer ("TSA"), and a Martindale Abrasion Rating of about 2 or more, as determined by a Martindale Wear and Abrasion Tester such as Model No. 103 or 403 from James H. Heal & Company, Ltd. of West Yorkshire, England.
10. The coform material of any preceding clause, wherein the nonwoven web comprises a hydroentangled web.
11. The coform material of any preceding clause, wherein the nonwoven web has a basis weight of from about 10 gsm to about 90 gsm.
12. The coform material of any preceding clause, wherein the nonwoven web has a mean cup crush energy of from about 110 gf*mm to about 850 gf*mm.
13. The coform material of any preceding clause, wherein the nonwoven web has a mean cup crush peak of from about 5 gf to about 60 gf.
14. The coform material of any preceding clause, wherein the nonwoven web has a mean machine direction (MD) tensile strength of from about 400 gf/inch to about 2500 gf/inch and a mean MD elongation % of from about 25% to about 40%.
15. The coform material of any preceding clause, wherein the nonwoven web has a mean cross direction (CD) tensile strength of from about 250 gf/inch to about 1250 gf/inch and a mean CD elongation % of from about 45% to about 80%.
16. A wiper product comprising the coform material of clause 1.
17. The wiper product of clause 16, wherein the nonwoven web is pre-saturated with a solvent.
18. A method for producing a coform nonwoven web, the method comprising: merging together a stream of an absorbent material including pulp fibers with a stream of staple fibers to form a composite stream, the staple fibers being present in an amount of from about 5 wt. % to about 50 wt. %, the pulp fibers being present in an amount of from about 50 wt. % to about 95 wt. %, wherein the staple fibers have an average length of from about 5 mm to about 50 mm; collecting the composite stream on a forming surface to form a coform nonwoven web; and bonding the coform nonwoven web, wherein bonding the coform nonwoven web comprises (i) hydraulically entangling the coform nonwoven web or (ii) thermally bonding the coform nonwoven web.
19. The method of clause 18, wherein collecting the composite stream comprises air laying the pulp fibers and staple fibers on the forming surface.
20. A system for forming a coform web, the system comprising: a first system configured to provide staple fibers; a second system configured to provide absorbent fibers; a first air stream disposed in a first duct, the first duct configured with one or more openings to receive staple fibers from the first system and absorbent fibers from the second system; a second air stream configured to disperse the staple fibers from the first system in the first air stream via a second duct; a third air stream configured to disperse the absorbent fibers with the first air stream containing the staple fibers in the first duct forming a composite stream, the third airstream disposed downstream from the second air stream; and a nozzle disposed on an end of the first duct for depositing the composite stream on a forming surface.

These and other modifications and variations to the present disclosure may be practiced by those of ordinary skill in the art, without departing from the spirit and scope of the present disclosure, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the disclosure so further described in such appended claims.

What is claimed is:

1. A coform material comprising:

a nonwoven web containing a mixture of staple fibers and an absorbent material including pulp fibers, the staple fibers being present in the nonwoven web in an amount of from about 5 wt. % to about 50 wt. %, the pulp fibers being present in the nonwoven web in an amount of from about 50 wt. % to about 95 wt. %, wherein the staple fibers have an average length of from about 5 mm to about 50 mm, wherein the staple fibers and pulp fibers are thermally bonded or hydraulically entangled to form the nonwoven web, wherein the nonwoven web is an air-formed nonwoven web, wherein the nonwoven web has a machine direction (MD) tensile strength of from about 539.40 N/m to about 965.22 N/m, further wherein the coform material is substantially free from thermoplastic polymer materials.

2. The coform material of claim 1, wherein the staple fibers are present in an amount of 5 wt. % to about 25 wt. % and the pulp fibers are present in an amount of from about 75 wt. % to about 95 wt. %.

3. The coform material of claim 1, wherein the staple fibers comprise regenerated cellulose, viscose rayon, cotton, wool, or combinations thereof.

4. The coform material of claim 1, wherein the staple fibers have an average length of at least about 10 mm up to about 40 mm.

5. The coform material of claim 1, wherein the staple fibers are present in the nonwoven web in an amount of about 30 wt. % or less.

6. The coform material of claim 1, having a TS7 softness value of about 8 or less, measured as an output of an EMTEC Tissue Softness Analyzer ("TSA"), and a Martindale Abrasion Rating of about 2 or more, as determined by a Martindale Wear and Abrasion Tester.

7. The coform material of claim 1, wherein the nonwoven web comprises a hydroentangled web.

8. The coform material of claim 1, wherein the nonwoven web has a basis weight of from about 10 gsm to about 90 gsm.

9. The coform material of claim 1, wherein the nonwoven web has a mean cup crush energy of from about 110 gf*mm to about 850 gf*mm.

10. The coform material of claim 1, wherein the nonwoven web has a mean cup crush peak of from about 5 gf to about 60 gf.

11. The coform material of claim 1, wherein the nonwoven web has a mean MD elongation % of from about 25% to about 40%.

12. The coform material of claim 1, wherein the nonwoven web has a mean cross direction (CD) tensile strength of from about 96.52 N/m to about 482.61 N/m and a mean CD elongation % of from about 45% to about 80%.

13. A wiper product comprising the coform material of claim 1.

14. The wiper product of claim 13, wherein the nonwoven web is pre-saturated with a solvent.

15. A method for producing a coform nonwoven web, the method comprising:

merging together a first air stream of an absorbent material including pulp fibers with a second air stream of staple fibers to form a composite air stream, the staple fibers being present in an amount of from about 5 wt. % to about 50 wt. %, the pulp fibers being present in an amount of from about 50 wt. % to about 95 wt. %, wherein the staple fibers have an average length of from about 5 mm to about 50 mm;

collecting the composite stream on a forming surface to form a coform nonwoven web; and bonding the coform nonwoven web, wherein bonding the coform nonwoven web comprises (i) hydraulically entangling the coform nonwoven web or (ii) thermally bonding the coform nonwoven web, wherein the coform nonwoven web is substantially free from thermoplastic polymer materials.

16. The method of claim 15, wherein collecting the composite stream comprises air laying the pulp fibers and staple fibers on the forming surface.

17. A system for forming a coform web, the system comprising:

a first system configured to provide staple fibers;

a second system configured to provide absorbent fibers;

a first air stream disposed in a first duct, the first duct configured with one or more openings to receive staple fibers from the first system and absorbent fibers from the second system;

a second air stream configured to disperse the staple fibers from the first system in the first air stream via a second duct;

a third air stream configured to disperse the absorbent fibers with the first air stream containing the staple fibers in the first duct forming a composite stream, the third air stream disposed downstream from the second air stream; and a nozzle disposed on an end of the first duct for depositing the composite stream on a forming surface, wherein the coform web is substantially free from thermoplastic polymer materials.

* * * * *